US008853964B2

(12) United States Patent
Sutardja et al.

(10) Patent No.: US 8,853,964 B2
(45) Date of Patent: Oct. 7, 2014

(54) CURRENT BALANCING CIRCUITS FOR LIGHT-EMITTING-DIODE-BASED ILLUMINATION SYSTEMS

(71) Applicant: Marvell World Trade Ltd., St. Michael (BB)

(72) Inventors: Sehat Sutardja, Los Altos Hills, CA (US); Ravishanker Krishnamoorthy, Singapore (SG)

(73) Assignee: Marvell World Trade Ltd., St. Michael (BB)

( * ) Notice: Subject to any disclaimer, the term of this patent is extended or adjusted under 35 U.S.C. 154(b) by 117 days.

(21) Appl. No.: 13/715,223

(22) Filed: Dec. 14, 2012

(65) Prior Publication Data

US 2013/0154510 A1 Jun. 20, 2013

Related U.S. Application Data

(60) Provisional application No. 61/576,511, filed on Dec. 16, 2011, provisional application No. 61/678,513, filed on Aug. 1, 2012.

(51) Int. Cl.
*H05B 37/02* (2006.01)
*H05B 33/08* (2006.01)

(52) U.S. Cl.
CPC ..... *H05B 37/02* (2013.01); *H05B 33/0866* (2013.01); *H05B 33/0827* (2013.01)
USPC ..... 315/291; 315/294; 315/300; 315/312; 323/312; 323/313; 323/315; 323/281

(58) Field of Classification Search
CPC ..... H05B 37/02; H05B 33/0827; H05B 33/0857; H05B 33/0866; G05F 3/26; G05F 3/262
USPC ..... 315/291, 294, 300, 312, 320, 112, 113; 323/312–315, 280, 281
See application file for complete search history.

(56) References Cited

U.S. PATENT DOCUMENTS 5,804,958 A * 9/1998 Tsui et al. ..... 323/313
5,929,622 A * 7/1999 Kardash ..... 323/315

(Continued)

FOREIGN PATENT DOCUMENTS

DE 102008030365 A1 8/2009
DE 102010033640 A1 2/2012

OTHER PUBLICATIONS

PCT International Search Report for corresponding International Application No. PCT/US2012/069792; Apr. 10, 2013; 5 pages.

*Primary Examiner* — Haiss Philogene

(57) ABSTRACT

A system including a first transistor, a second transistor, and a comparator. The first transistor is configured to supply a first current to a first load connected to a first terminal of the first transistor. The second transistor is configured to supply a second current to a second load connected to a first terminal of the second transistor, wherein the first current and the second current have a predetermined ratio. The comparator is configured to compare a voltage at the first terminal of the first transistor or a voltage at the first terminal of the second transistor to a reference voltage, and to adjust, based on the comparison, biasing of the first transistor and the second transistor to maintain the predetermined ratio between the first current and the second current.

47 Claims, 14 Drawing Sheets

(56) References Cited

U.S. PATENT DOCUMENTS

| | | | | |
|---|---|---|---|---|
| 8,334,662 | B2 * | 12/2012 | Jin et al. | 315/299 |
| 8,598,853 | B2 * | 12/2013 | Tang et al. | 323/272 |
| 2008/0252197 | A1 | 10/2008 | Li et al. | |
| 2009/0096388 | A1 | 4/2009 | Prexl | |
| 2009/0195191 | A1 | 8/2009 | Lin et al. | |
| 2011/0285321 | A1 | 11/2011 | Li et al. | |
| 2012/0146519 | A1 | 6/2012 | Briggs | |

* cited by examiner

CURRENT BALANCING CIRCUITS FOR LIGHT-EMITTING-DIODE-BASED ILLUMINATION SYSTEMS

CROSS-REFERENCE TO RELATED APPLICATIONS

This application claims the benefit of U.S. Provisional Application No. 61/576,511, filed Dec. 16, 2011 and U.S. Provisional Application No. 61/678,513, filed Aug. 1, 2012. The entire disclosures of the above applications are incorporated herein by reference.

FIELD

The present disclosure relates generally to light emitting diode (LED)-based illumination systems and more particularly to current balancing circuits for LED-based illumination systems.

BACKGROUND

The background description provided herein is for the purpose of generally presenting the context of the disclosure. Work of the presently named inventors, to the extent the work is described in this background section, as well as aspects of the description that may not otherwise qualify as prior art at the time of filing, are neither expressly nor impliedly admitted as prior art against the present disclosure.

Light emitting diode (LED)-based illumination systems are being increasingly used particularly in commercial applications. Some examples of commercial applications where LED-based illumination systems are used include billboards, computer displays, and television screens. LED-based lamps can also be used in home and office environments. For example, LED-based lamps having the shape of a conventional light bulb or a tube light can be used in home and office environments. LED-based lamps that can be used in home and office environments, however, are not yet as affordable as incandescent and fluorescent lamps.

Lamps that generate white light are generally preferred in home and office environments. LEDs can be used to manufacture lamps that generate white light. For example, LEDs that generate red, green, and blue light can be used to manufacture lamps that generate white light. Specifically, light generated by red, green, and blue LEDs can be combined to produce white light. LEDs that generate pure red and green light, however, can be relatively expensive.

Alternatively, LEDs that generate blue light and phosphors that convert blue light into red and green light can be used to produce white light. Specifically, blue LEDs can be coated with a mixture of red and green phosphors. Some of the blue light output by the blue LEDs is converted to red and green light by the red and green phosphors, respectively. Some of the blue light output by the blue LEDs may escape the phosphors without getting converted. The red and green light converted by the phosphors combines with the blue light that escapes unconverted to produce white light.

The mixture of red and green phosphors produces optimum light output when excited by blue light having specific wavelengths. For example, most red and green phosphors convert blue light optimally when the wavelength of the blue light is approximately 450 nm. Accordingly, blue LEDs that produce blue light within a narrow range of wavelengths (e.g., 450 nm±5 nm) are typically selected to generate white light, and blue LEDs that produce light having wavelengths outside of the narrow range of wavelengths are typically rejected. The stringent selection process and rejection of numerous LEDs increases the cost of generating white light using blue LEDs. Additionally, the coating of the phosphor mixture may not be uniform across the LEDs. Due to variations in the coating, the whiteness of the light produced by the LEDs may vary from LED to LED. Accordingly, the LEDs need to be selected using a binning process, which further increases cost.

SUMMARY

A system includes a first transistor, a second transistor, and a comparator. The first transistor is configured to supply a first current to a first load connected to a first terminal of the first transistor. The second transistor is configured to supply a second current to a second load connected to a first terminal of the second transistor, where the first current and the second current have a predetermined ratio. The comparator is configured to compare a voltage at the first terminal of the first transistor or a voltage at the first terminal of the second transistor to a reference voltage, and to adjust, based on the comparison, biasing of the first transistor and the second transistor to maintain the predetermined ratio between the first current and the second current.

In other features, in response to a change in the first current, the adjusted biasing changes the second current in accordance with the predetermined ratio between the first current and the second current.

In other features, the predetermined ratio between the first current and the second current is based on a ratio of areas of the first transistor and the second transistor.

In other features, in response to a change in power received by the first load and the second load, the comparator is configured to adjust the biasing of the first transistor and the second transistor to maintain the predetermined ratio between the first current and the second current.

In other features, in response to a change in power received by the first load and the second load, the comparator is configured to adjust the first current and the second current to maintain the predetermined ratio between the first current and the second current.

In other features, the first load includes a first set of light emitting diodes configured to generate light having first wavelengths in a first wavelength range in a spectrum of blue light. The second load includes a second set of light emitting diodes configured to generate light having second wavelengths in a second wavelength range in the spectrum of blue light. The first wavelength range is less than a third wavelength range in the spectrum of blue light. The second wavelength range is greater than the third wavelength range. The light generated by the first set of light emitting diodes and the second set of light emitting diodes combines to produce white light. A color temperature of the white light depends on the predetermined ratio.

In other features, the first wavelengths are less than or equal to 450 nanometers, and the second wavelengths are greater than or equal to 470 nanometers.

In other features, the first wavelengths are between 420 nanometers and 450 nanometers, and the second wavelengths are between 470 nanometers and 490 nanometers.

In other features, the first load includes a first set of light emitting diodes configured to generate blue light having first wavelengths in a first wavelength range in a spectrum of blue light. The second load includes a second set of light emitting diodes configured to generate blue light having second wavelengths in a second wavelength range in the spectrum of blue light. The system further comprises a green phosphor configured to convert a first portion of the blue light having the first wavelengths into green light, and allow a second portion of the blue light having the first wavelengths to escape unconverted. The system further comprises a red phosphor configured to convert a third portion of the blue light having the second wavelengths into red light, and allow a fourth portion of the blue light having the second wavelengths to escape unconverted. The green light, the red light, the second portion of the blue light having the first wavelengths, and fourth portion of the blue light having the second wavelengths combine to produce white light. A color temperature of the white light depends on the predetermined ratio.

In other features, the first wavelength range is less than a third wavelength range in the spectrum of blue light, and the second wavelength range is greater than the third wavelength range.

In still other features, a system includes a first transistor, a second transistor, a third transistor, and a comparator. The first transistor is configured to supply a first current to a first set of light emitting diodes connected to a first terminal of the first transistor. The first set of light emitting diodes is configured to output light having first wavelengths in a first wavelength range in a spectrum of blue light. The second transistor is configured to supply a second current to a second set of light emitting diodes connected to a first terminal of the second transistor. The second set of light emitting diodes is configured to output light having second wavelengths in a second wavelength range in the spectrum of blue light. The third transistor is configured to supply a third current to a third set of light emitting diodes connected to a first terminal of the third transistor. The third set of light emitting diodes is configured to output light having third wavelengths in a third wavelength range in the spectrum of blue light. The third wavelength range is (i) less than the second wavelength range and (ii) greater than the first wavelength range. Values of the first current, the second current, and the third current are in a predetermined proportion. The light having the first, second, and third wavelengths combines to generate white light. The comparator is configured to compare a voltage at the first terminal of the first transistor, a voltage at the first terminal of the second transistor, or a voltage at the first terminal of the third transistor to a reference voltage, and to adjust, based on the comparison, biasing of the first transistor, the second transistor, and the third transistor to maintain the predetermined proportion between the first current, the second current, and the third current. A color temperature of the white light depends on the predetermined proportion of the first current, the second current, and the third current.

In still other features, a method comprises supplying a first current to a first load connected to a first terminal of a first transistor. The method further comprises supplying a second current to a second load connected to a first terminal of a second transistor, where the first current and the second current have a predetermined ratio. The method further comprises comparing a voltage at the first terminal of the first transistor or a voltage at the first terminal of the second transistor to a reference voltage. The method further comprises adjusting, based on the comparison, biasing of the first transistor and the second transistor to maintain the predetermined ratio between the first current and the second current.

In still other features, a method comprises supplying a first current to a first set of light emitting diodes connected to a first terminal of a first transistor. The method further comprises outputting, from the first set of light emitting diodes, light having first wavelengths in a first wavelength range in a spectrum of blue light. The method further comprises supplying a second current to a second set of light emitting diodes connected to a first terminal of a second transistor. The method further comprises outputting, from the second set of light emitting diodes, light having the first wavelengths in the first wavelength range in the spectrum of blue light. The method further comprises supplying a third current to a third set of light emitting diodes connected to a first terminal of a third transistor. The method further comprises outputting, from the third set of light emitting diodes, light having second wavelengths in a second wavelength range in a spectrum of ultraviolet light, where values of the first current, the second current, and the third current are in a predetermined proportion. The method further comprises comparing a voltage at the first terminal of the first transistor, a voltage at the first terminal of the second transistor, or a voltage at the first terminal of the third transistor to a reference voltage. The method further comprises adjusting, based on the comparison, biasing of the first transistor, the second transistor, and the third transistor to maintain the predetermined proportion between the first current, the second current, and the third current. A color temperature of white light generated based on the light output by the first, second, and third sets of light emitting diodes depends on the predetermined proportion of the first current, the second current, and the third current.

In still other features, a system includes a first set of light emitting diodes, a second set of light emitting diodes, and a control module. The first set of light emitting diodes is configured to emit blue light having first wavelengths in a first wavelength range in a spectrum of blue light. The first set of light emitting diodes includes a green phosphor configured to convert the blue light having the first wavelengths to green light. The second set of light emitting diodes is configured to emit blue light having second wavelengths in a second wavelength range in the spectrum of blue light. The second set of light emitting diodes includes a red phosphor configured to convert the blue light having the second wavelengths to red light. The first wavelength range is less than the second wavelength range. The control module is configured to control currents through the first set of light emitting diodes and the second set of light emitting diodes.

In other features, the system further comprises a third set of light emitting diodes configured to emit blue light having third wavelengths in a third wavelength range in the spectrum of blue light. The third wavelength range is (i) less than the second wavelength range and (ii) greater than the first wavelength range. The control module is configured to control current through the third set of light emitting diodes.

In other features, the system further comprises a third set of light emitting diodes configured to emit blue light having a plurality of wavelengths in a third wavelength range in the spectrum of blue light. The third wavelength range is (i) less than the second wavelength range and (ii) greater than the first wavelength range. Light emitting diodes in the third set of light emitting diodes are arranged in a predetermined order. The predetermined order is based on the plurality of wavelengths. The control module is configured to control current through the third set of light emitting diodes.

In other features, the system further comprises a third set of light emitting diodes that (i) is configured to emit ultraviolet light and (ii) includes a phosphor configured to convert the ultraviolet light into blue light having third wavelengths in a third wavelength range in the spectrum of blue light. The third wavelength range is (i) less than the second wavelength range and (ii) greater than the first wavelength range. The control module is configured to control current through the third set of light emitting diodes.

In other features, the green light generated from the first set of light emitting diodes, the red light generated from the second set of light emitting diodes, and the blue light generated from the third set of light emitting diodes combine to generate white light. The control module is configured to control currents through the first set of light emitting diodes, the second set of light emitting diodes, and the third set of light emitting diodes to control at least one of (i) brightness and (ii) a color temperature of the white light.

In other features, the system further comprises a third set of light emitting diodes configured to emit blue light having third wavelengths in a third wavelength range in the spectrum of blue light. The third wavelength range is (i) less than the second wavelength range and (ii) greater than the first wavelength range. The third set of light emitting diodes includes an amber phosphor configured to (i) convert a portion of the blue light having the third wavelengths to red light and (ii) allow a remainder of the blue light having the third wavelengths to pass through the amber phosphor unconverted. The control module is configured to control current through the third set of light emitting diodes and decrease current through the second set of light emitting diodes based on an amount of red light output by the third set of light emitting diodes.

In still other features, a system includes a first set of light emitting diodes, a second set of light emitting diodes, and a control module. The first set of light emitting diodes is configured to emit blue light having first wavelengths in a first wavelength range. The first wavelength range corresponds to a first of three portions of a spectrum of blue light. The three portions of the spectrum of blue light include wavelengths of blue light in ascending order. The first portion includes wavelengths shorter than the second and third of the three portions. The first set of light emitting diodes includes a first phosphor configured to convert the blue light having the first wavelengths to green light. The second set of light emitting diodes is configured to emit blue light having second wavelengths in a second wavelength range. The second wavelength range corresponds to the third portion of the spectrum of blue light. The third portion includes wavelengths longer than the first and second portions. The second set of light emitting diodes includes a second phosphor configured to convert the blue light having the second wavelengths to red light. The control module is configured to control currents through the first set of light emitting diodes and the second set of light emitting diodes.

In other features, the system further comprises a third set of light emitting diodes configured to emit blue light having third wavelengths in a third wavelength range. The third wavelength range corresponds to the second portion of the spectrum of blue light. The second portion includes wavelengths longer than the first portion and shorter than the third portion. The control module is configured to control current through the third set of light emitting diodes.

In other features, the system further comprises a third set of light emitting diodes configured to emit blue light having a plurality of wavelengths in a third wavelength range. The third wavelength range corresponds to the second portion of the spectrum of blue light. The second portion includes wavelengths longer than the first portion and shorter than the third portion. Light emitting diodes in the third set of light emitting diodes are arranged in a predetermined order. The predetermined order is based on the plurality of wavelengths. The control module is configured to control current through the third set of light emitting diodes.

In other features, the system further comprises a third set of light emitting diodes that (i) is configured to emit ultraviolet light and (ii) includes a phosphor configured to convert the ultraviolet light into blue light having third wavelengths in a third wavelength range. The third wavelength range corresponds to the second portion of the spectrum of blue light. The second portion includes wavelengths longer than the first portion and shorter than the third portion. The control module is configured to control current through the third set of light emitting diodes.

In other features, the system further comprises a third set of light emitting diodes configured to emit blue light having third wavelengths in a third wavelength range. The third wavelength range corresponds to the second portion of the spectrum of blue light. The second portion includes wavelengths longer than the first portion and shorter than the third portion. The third set of light emitting diodes includes a third phosphor configured to (i) convert a portion of the blue light having the third wavelengths to red light and (ii) allow a remainder of the blue light emitted by the third set of light emitting diodes to pass through the third phosphor unconverted. The control module is configured to control current through the third set of light emitting diodes and decrease current through the second set of light emitting diodes based on an amount of red light generated from the third set of light emitting diodes.

In still other features, a system includes first, second, and third sets of light emitting diodes and a control module. The first set of light emitting diodes is configured to emit blue light having first wavelengths in a first wavelength range in a spectrum of blue light. The first set of light emitting diodes includes a first phosphor configured to convert the blue light having the first wavelengths to light of a first color. The second set of light emitting diodes is configured to emit blue light having the first wavelengths in the first wavelength range in the spectrum of blue light. The second set of light emitting diodes includes a second phosphor configured to convert the blue light having the first wavelengths to light of a second color. The third set of emitting diodes is configured to emit ultraviolet light having second wavelengths in a second wavelength range in a spectrum of ultraviolet light. The third set of light emitting diodes includes a third phosphor configured to convert the ultraviolet light having the second wavelengths to blue light. The control module is configured to control currents through the first, second, and third sets of light emitting diodes. The light having first and second colors combines with the blue light generated by the third set of light emitting diodes to produce white light. A color temperature of the white light is based on the currents through the first, second, and third sets of light emitting diodes.

In other features, the first phosphor is a green phosphor, and the first color is green; the second phosphor is a red phosphor, and the second color is red; and the light having green and red colors combines with the blue light to produce the white light.

In other features, the first phosphor is a reddish yellow phosphor, and the first color is reddish yellow; the second phosphor is a yellow phosphor, and the second color is yellow; and the light having reddish yellow and yellow colors combines with the blue light to produce the white light.

In other features, the first phosphor is a red phosphor, and the first color is red; the second phosphor is a yellow phosphor, and the second color is yellow; and the light having red and yellow colors combines with the blue light to produce the white light.

In still other features, a method comprises emitting, from a first set of light emitting diodes, blue light having first wavelengths in a first wavelength range in a spectrum of blue light. The method further comprises converting, using a green phosphor, the blue light having the first wavelengths to green light. The method further comprises emitting, from a second set of light emitting diodes, blue light having second wavelengths in a second wavelength range in the spectrum of blue light, where the first wavelength range is less than the second wavelength range. The method further comprises converting, using a red phosphor, the blue light having the second wavelengths to red light. The method further comprises controlling currents through the first set of light emitting diodes and the second set of light emitting diodes.

In other features, the method further comprises emitting, from a third set of light emitting diodes, blue light having third wavelengths in a third wavelength range in the spectrum of blue light, where the third wavelength range is (i) less than the second wavelength range and (ii) greater than the first wavelength range; and controlling current through the third set of light emitting diodes.

In other features, the method further comprises arranging a third set of light emitting diodes in a predetermined order, where the predetermined order is based on a plurality of wavelengths. The method further comprises emitting, from the third set of light emitting diodes, blue light having the plurality of wavelengths in a third wavelength range in the spectrum of blue light, where the third wavelength range is (i) less than the second wavelength range and (ii) greater than the first wavelength range. The method further comprises controlling current through the third set of light emitting diodes.

In other features, the method further comprises emitting, from a third set of light emitting diodes, ultraviolet light. The method further comprises converting, using a phosphor, the ultraviolet light into blue light having third wavelengths in a third wavelength range in the spectrum of blue light, where the third wavelength range is (i) less than the second wavelength range and (ii) greater than the first wavelength range. The method further comprises controlling current through the third set of light emitting diodes.

In other features, the method further comprises emitting, from a third set of light emitting diodes, blue light having third wavelengths in a third wavelength range in the spectrum of blue light, where the third wavelength range is (i) less than the second wavelength range and (ii) greater than the first wavelength range. The method further comprises converting, using an amber phosphor, a portion of the blue light having the third wavelengths to red light. The method further comprises allowing a remainder of the blue light having the third wavelengths to pass through the amber phosphor unconverted. The method further comprises controlling current through the third set of light emitting diodes and decrease current through the second set of light emitting diodes based on an amount of red light generated from the third set of light emitting diodes.

In still other features, a method comprises emitting, using a first set of light emitting diodes, blue light having first wavelengths in a first wavelength range in a spectrum of blue light. The method further comprises converting, using a first phosphor, the blue light having the first wavelengths to light of a first color. The method further comprises emitting, using a second set of light emitting diodes, blue light having the first wavelengths in the first wavelength range in the spectrum of blue light. The method further comprises converting, using a second phosphor, the blue light having the first wavelengths to light of a second color. The method further comprises emitting, using a third set of emitting diodes, ultraviolet light having second wavelengths in a second wavelength range in a spectrum of ultraviolet light. The method further comprises converting, using a third phosphor, the ultraviolet light having the second wavelengths to blue light. The method further comprises controlling currents through the first, second, and third sets of light emitting diodes. The method further comprises producing white light by combining the light having first and second colors with the blue light generated by the third set of light emitting diodes. The method further comprises controlling a color temperature of the white light is based on the currents through the first, second, and third sets of light emitting diodes.

In still other features, a lamp includes a first set of light emitting diodes configured to generate first light, a second set of light emitting diodes configured to generate second light, and a third set of light emitting diodes configured to generate third light. The first light, the second light, and the third light combine to produce white light. A first switch is located at a base portion of the lamp. A state of the first switch corresponds to a color temperature of the white light. A color temperature adjustment module is configured to vary outputs of the first, second, and third sets of light emitting diodes in accordance with the color temperature of the white light selected by a user using the first switch.

In other features, the color temperature adjustment module includes a current control module configured to control current through at least one of (i) the first set of light emitting diodes, (ii) the second set of light emitting diodes, and (iii) the third set of light emitting diodes in accordance with the color temperature of the white light selected by the user using the first switch.

In other features, the first switch is configured to allow the user to select the color temperature of the white light from a group consisting of 4000 degrees Kelvin, 3500 degrees Kelvin, 3000 degrees Kelvin, 2700 degrees Kelvin.

In other features, the lamp further comprises a current control module configured to supply a first current to the first set of light emitting diodes, supply a second current to the second set of light emitting diodes, supply a third current to the third set of light emitting diodes, select a first proportion for the first current, the second current, and the third current in response to the user setting the first switch to a first position, and select a second proportion for the first current, the second current, and the third current in response to the user setting the first switch to a second position.

In still other features, a lamp includes first, second, and third sets of light emitting diodes, a first switch, and a color temperature adjustment module. The first set of light emitting diodes is configured to emit blue light having first wavelengths in a first wavelength range in a spectrum of blue light. The first set of light emitting diodes includes a first phosphor configured to convert the blue light having the first wavelengths to light of a first color. The second set of light emitting diodes is configured to emit blue light having the first wavelengths in the first wavelength range in the spectrum of blue light. The second set of light emitting diodes includes a second phosphor configured to convert the blue light having the first wavelengths to light of a second color. The third set of light emitting diodes is configured to emit ultraviolet light having second wavelengths in a second wavelength range in a spectrum of ultraviolet light. The third set of light emitting diodes includes a third phosphor configured to convert the ultraviolet light having the second wavelengths to blue light. The light having the first and second colors combines with the blue light generated by the third set of light emitting diodes to produce white light. The first switch is located at a base portion of the lamp. A state of the first switch corresponds to a color temperature of the white light. The color temperature adjustment module is configured to vary outputs of the first, second, and third sets of light emitting diodes in accordance with the color temperature of the white light selected by a user using the first switch.

In still other features, a method comprises generating first light using a first set of light emitting diodes, generating second light using a second set of light emitting diodes, and generating third light using a third set of light emitting diodes. The method further comprises producing white light by combining the first light, the second light, and the third light. The method further comprises changing a state of a first switch located at a base portion of a lamp comprising the first, second, and third sets of light emitting diodes, where the state of the first switch corresponds to a color temperature of the white light. The method further comprises varying outputs of the first, second, and third sets of light emitting diodes in accordance with the color temperature of the white light selected by a user using the first switch.

In still other features, a method comprises emitting, using a first set of light emitting diodes, blue light having first wavelengths in a first wavelength range in a spectrum of blue light. The method further comprises converting, using a first phosphor, the blue light having the first wavelengths to light of a first color. The method further comprises emitting, using a second set of light emitting diodes, blue light having the first wavelengths in the first wavelength range in the spectrum of blue light. The method further comprises converting, using a second phosphor, the blue light having the first wavelengths to light of a second color. The method further comprises emitting, using a third set of light emitting diodes, ultraviolet light having second wavelengths in a second wavelength range in a spectrum of ultraviolet light. The method further comprises converting, using a third phosphor, the ultraviolet light having the second wavelengths to blue light. The method further comprises producing white light by combining the light having the first and second colors with the blue light generated by the third set of light emitting diodes. The method further comprises changing a state of a first switch located at a base portion of a lamp comprising the first, second, and third sets of light emitting diodes, where the state of the first switch corresponds to a color temperature of the white light. The method further comprises varying outputs of the first, second, and third sets of light emitting diodes in accordance with the color temperature of the white light selected by a user using the first switch.

In still other features, a system includes a base portion, a glass layer, and a plurality of coatings of a first phosphor and a second phosphor. The base portion includes (i) a first set of light emitting diodes configured to emit blue light having first wavelengths in a first wavelength range in a spectrum of blue light, and (ii) a second set of light emitting diodes configured to emit blue light having second wavelengths in a second wavelength range in the spectrum of blue light. Light emitting diodes of the first set and the second set of light emitting diodes are (i) arranged on the base portion in an alternating pattern, and (ii) are separated from each other by a first predetermined distance. The glass layer is arranged at a second predetermined distance from the base portion. The plurality of coatings of a first phosphor and a second phosphor is arranged in an alternating pattern on a surface of the glass layer facing toward the light emitting diodes. Each of the coatings has a predetermined length. Centers of the coatings of the first phosphor align with centers of corresponding light emitting diodes in the first set of light emitting diodes. Centers of coatings of the second phosphor align with centers of corresponding light emitting diodes in the second set of light emitting diodes.

In other features, the light emitting diodes of the first set and the second set of light emitting diodes are arranged on the base portion along a straight line, and the plurality of coatings of the first phosphor and the second phosphor is arranged along a straight line on the surface of the glass layer facing toward the light emitting diodes.

In still other features, a lamp includes a first set of light emitting diodes and a second set of light emitting diodes, and a plurality of coatings of green and red phosphors. The first set of light emitting diodes and a second set of light emitting diodes are respectively configured to emit blue light having (i) first wavelengths in a first wavelength range in a spectrum of blue light and (ii) second wavelengths in a second wavelength range in the spectrum of blue light. The first set and the second set of light emitting diodes are evenly spaced in an alternating pattern on a base portion of the lamp. The plurality of coatings of green and red phosphors is evenly spaced in an alternating pattern on a glass surface of the lamp. The green phosphor is configured to convert a first portion of blue light having the first wavelengths to green light and to allow a second portion of blue light having the first wavelengths to escape unconverted. The red phosphor is configured to convert a third portion of blue light having the second wavelengths to red light, and to allow a fourth portion of blue light having the second wavelengths to escape unconverted. The green light, the red light, and the second and fourth portions of the blue light combine to produce white light.

In still other features, a lamp includes first, second, and third sets of light emitting diodes, and a plurality of coatings of first, second, and third phosphors. The first set of light emitting diodes and the second set of light emitting diodes are configured to emit blue light having first wavelengths in a first wavelength range in a spectrum of blue light. The third set of light emitting diodes is configured to emit ultraviolet light. The first, second, and third sets of light emitting diodes are evenly spaced in an alternating pattern on a base portion of the lamp. The plurality of coatings of first, second, and third phosphors is evenly spaced in an alternating pattern on a glass surface of the lamp. The first phosphor is configured to convert the blue light having the first wavelengths to a first light having a first color. The second phosphor is configured to convert the blue light having the first wavelengths to a second light having a second color. The third phosphor is configured to convert the ultraviolet light to blue light. The first light, the second light, and the blue light combine to produce white light.

In still other features, a method comprises arranging, on a base portion of a lamp, first and second sets of light emitting diodes in an alternating pattern; and separating the first and second sets of light emitting diodes from each other by a first predetermined distance. The method further comprises emitting, from the first set of light emitting diodes, blue light having first wavelengths in a first wavelength range in a spectrum of blue light. The method further comprises emitting, from the second set of light emitting diodes, blue light having second wavelengths in a second wavelength range in the spectrum of blue light. The method further comprises arranging a glass layer at a second predetermined distance from the base portion; and arranging, on a surface of the glass layer facing toward the first and second sets of light emitting diodes, a plurality of coatings of a first phosphor and a second phosphor in an alternating pattern, where each of the coatings has a predetermined length. The method further comprises aligning centers of the coatings of the first phosphor with centers of corresponding light emitting diodes in the first set of light emitting diodes; and aligning centers of coatings of the second phosphor with centers of corresponding light emitting diodes in the second set of light emitting diodes.

In still other features, a method comprises arranging, on a base portion of a lamp, first, second, and third sets of light emitting diodes in an alternating pattern, where the first, second, and third sets of light emitting diodes are evenly spaced on the base portion of the lamp. The method further comprises emitting, from first and second sets of light emitting diodes, blue light having first wavelengths in a first wavelength range in a spectrum of blue light. The method further comprises emitting ultraviolet light from a third set of light emitting diodes. The method further comprises arranging, a plurality of coatings of first, second, and third phosphors in an alternating pattern on a glass surface of the lamp, where the first, second, and third phosphors are evenly spaced. The method further comprises converting, using the first phosphor, the blue light having the first wavelengths to a first light having a first color. The method further comprises converting, using the second phosphor, the blue light having the first wavelengths to a second light having a second color. The method further comprises converting, using the third phosphor, the ultraviolet light to blue light. The method further comprises producing white light by combining the first light, the second light, and the blue light.

Further areas of applicability of the present disclosure will become apparent from the detailed description, the claims and the drawings. The detailed description and specific examples are intended for purposes of illustration only and are not intended to limit the scope of the disclosure.

BRIEF DESCRIPTION OF DRAWINGS

The present disclosure will become more fully understood from the detailed description and the accompanying drawings, wherein.

DESCRIPTION

Figure 1:
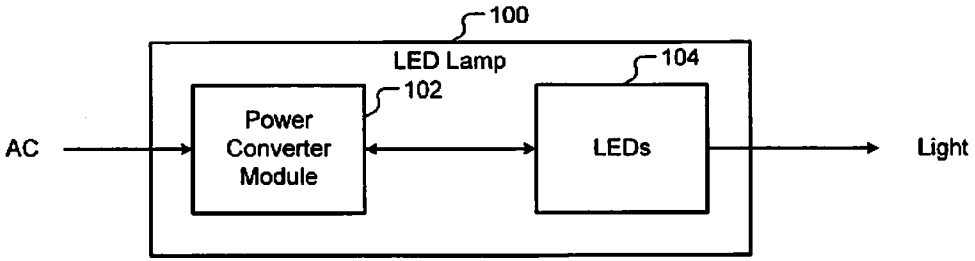
FIG. 1 is a functional block diagram of a light emitting diode (LED)-based lamp according to the present disclosure.

Blue LEDs that output light over a wide range of wavelengths can be used to generate white light. Specifically, blue LEDs that output light having wavelengths closer to a lower end of a spectrum of blue light (e.g., less than 450 nm) and an upper end of the spectrum of blue light (e.g., greater than 470 nm) can be utilized. Additionally, blue LEDs that output light having wavelengths within a range around 450 nm can also be used. Thus, essentially, blue LEDs that output light having wavelengths spanning an entire spectrum of blue light can be utilized to generate white light.

More specifically, a first set of blue LEDs that output blue light having first wavelengths closer to the lower end of the spectrum of blue light (e.g., less than 450 nm) can be used to generate green light. A second set of blue LEDs that output blue light having second wavelengths closer to the upper end of the spectrum of blue light (e.g., greater than 470 nm) can be used to generate red light. Additionally, a third set of blue LEDs that output light having wavelengths between the first and second wavelengths can also be used. For example only, the third set of LEDs may produce blue light having wavelengths within a range of about ±5 nm, ±10 nm, or ±15 nm around 450 nm. Alternatively, the third set of LEDs may include LEDs that emit ultraviolet light instead of blue light and may be coated with a phosphor that converts the ultraviolet light into a wideband blue light. The wideband blue light may have wavelengths spanning an entire spectrum of blue light including wavelengths less than or equal to 450 nm, 450 nm-470 nm, and wavelengths greater than or equal to 470 nm.

The first set of LEDs can be coated with a green phosphor that converts the blue light having the first wavelengths to green light. The second set of LEDs can be coated with a red phosphor that converts the blue light having the second wavelengths to red light. The third set of LEDs may not be coated with a phosphor that converts blue light into a light of a different color. The green, red, and blue light output by the first, second, and third sets of LEDs can be combined to produce white light. Accordingly, the first and second sets of LEDs that would otherwise be rejected can be utilized to generate white light. Utilizing LEDs that are typically rejected can reduce the cost of LED-based lamps generating white light.

Since white light can be produced using less blue light and more red light, the third set of LEDs producing blue light may be coated with amber phosphor. The amber phosphor can be coated so that only a portion of the blue light produced by the third set of LEDs is converted to red light, and some of the blue light produced by the third set of LEDs can escape unconverted through the amber phosphor. Since the third set of LEDs and the amber phosphor would produce some of the red light required to generate white light, current through the second set of LEDs that produce red light may be reduced to produce less red light. White light is produced by a sum of the red light produced by the second and third sets of LEDs, green light produced by the first set of LEDs, and blue light that escapes unconverted from the second and third sets of LEDs.

Brightness and/or color temperature (also called whiteness) of the white light can be controlled by controlling current through one or more sets of the LEDs individually. For example, if white light is produced using first, second, and third strings of LEDs that respectively generate green, red, and blue light, current through each LED string may be individually controlled to control the brightness and/or color temperature of the white light.

Conventionally, current through each LED string is controlled by using a Buck converter operated in current mode. Controlling current using a Buck converter in each LED string, however, requires at least one inductor and one capacitor per LED string and additional external components including resistors. Further changes in brightness need to be communicated to the current controller, which requires additional components. These additional components increase cost.

The present disclosure relates to current balancing circuits that control current through LEDs without using inductors. Specifically, the current balancing circuits according to the present disclosure maintain currents through a plurality of LED strings at a predetermined proportion and output white light of a predetermined color temperature. The current balancing circuits maintain the currents at the predetermined proportion regardless of an increase or decrease in the amount of power supplied to the LED strings (e.g., when a user changes the brightness level). When the power increases (e.g., to make the white light brighter), the current balancing circuits increase currents through the LED strings in the same predetermined proportion. When the power decreases (e.g., to make the white light dimmer), the current balancing circuits decrease currents through the LED strings in the same predetermined proportion to maintain the whiteness of the light. However, a predetermined set of values for the currents through the LED strings can also be used to match the color of the light emitted by an incandescent or a halogen light bulb. Making the light more reddish while dimming is similar to natural sun light. Also, light emitted by incandescent bulbs becomes more yellowish at lower power, and such light is more pleasing to human eye.

Figure 4:
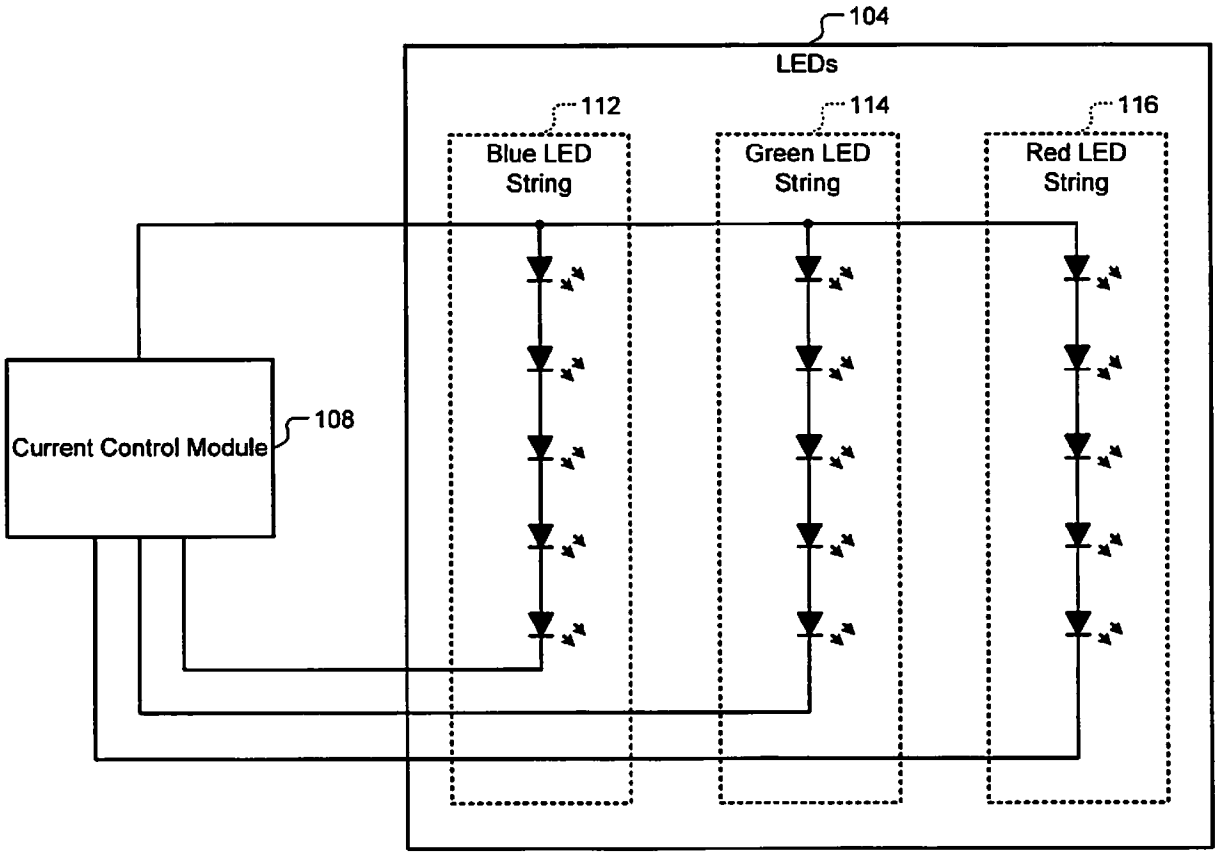
FIG. 4 depicts a current control module to control currents through a plurality of strings of LEDs according to the present disclosure.
Figure 5A:
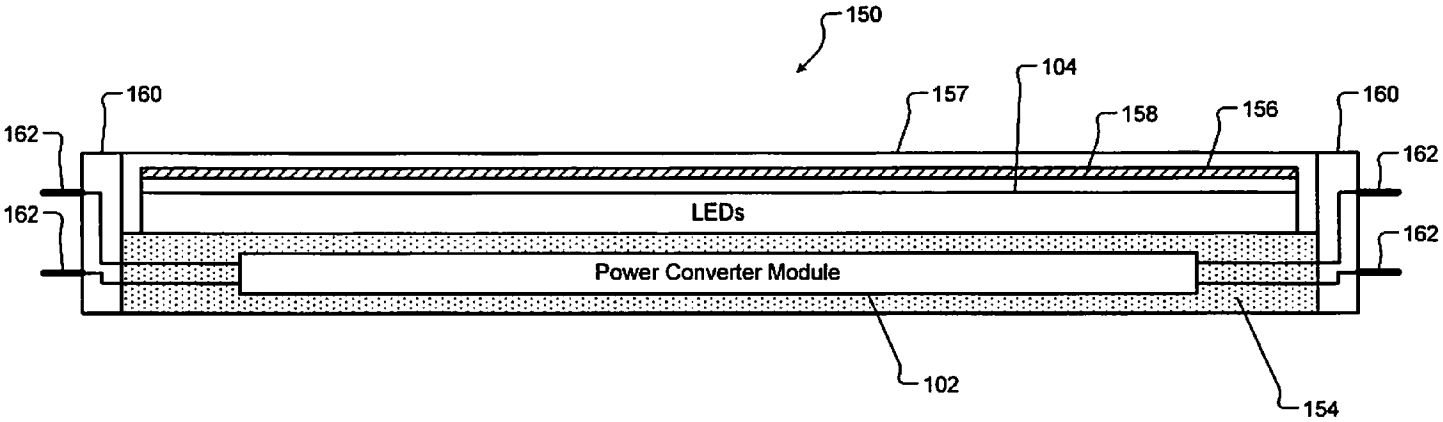
FIG. 5A depicts a LED lamp having the shape of a conventional tube light that uses LED and phosphor layouts according to the present disclosure.
Figure 6:
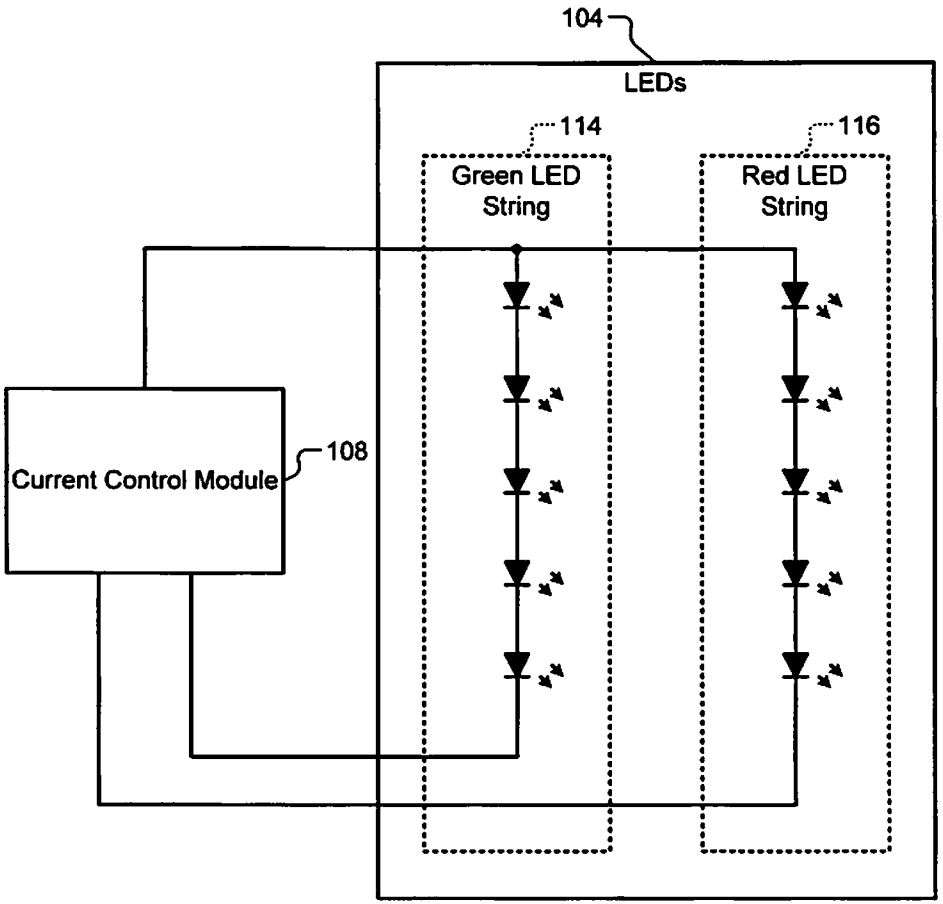
FIG. 6 depicts a current control module to control currents through a plurality of strings of LEDs used in the LED lamp of FIG. 5A according to the present disclosure.
Figure 7:
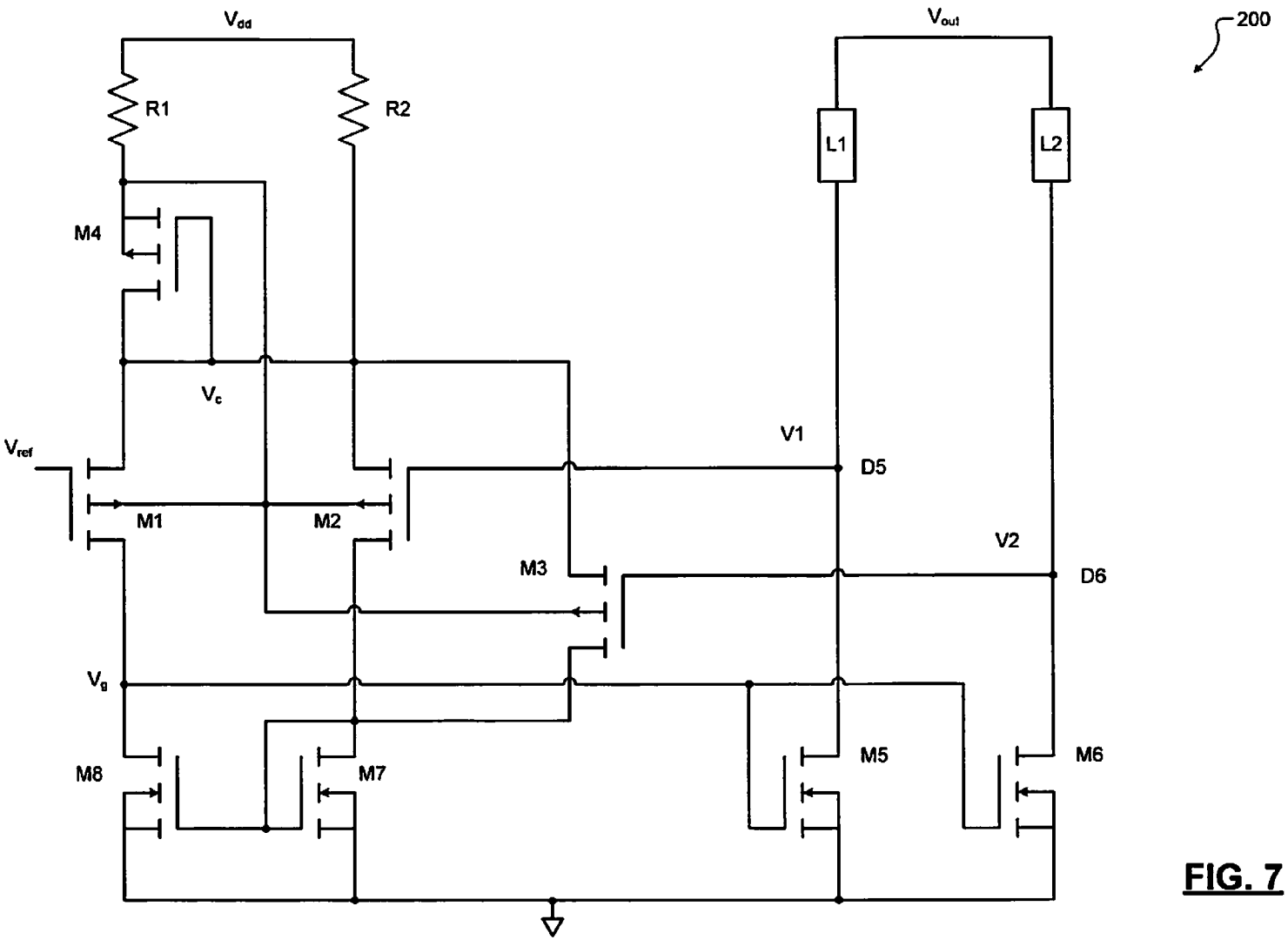
FIG. 7 is a schematic of a current balancing circuit that uses current mirroring and feedback to control currents through a plurality of loads according to the present disclosure.
Figure 8:
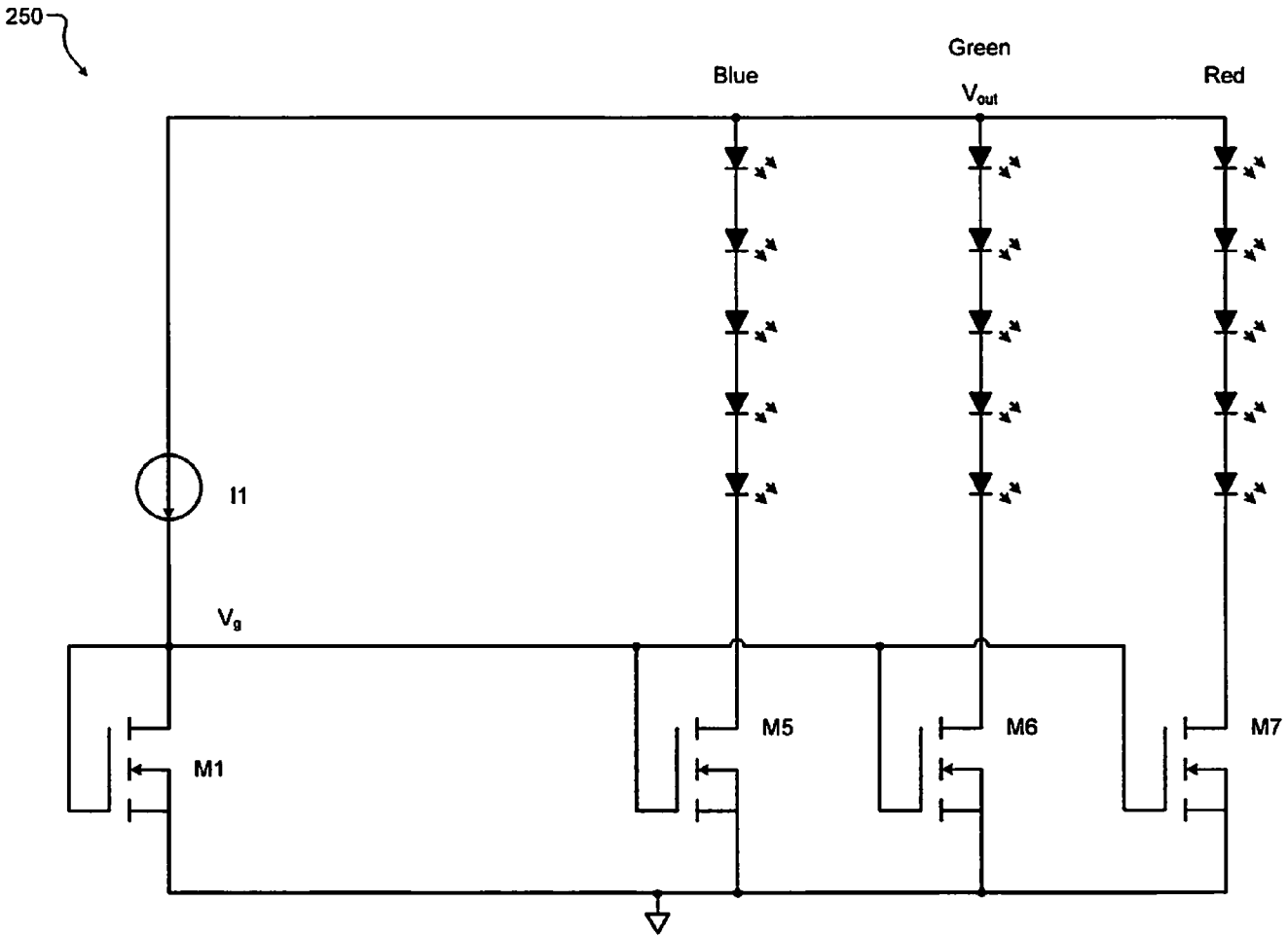
FIG. 8 is a schematic of a simple current mirror circuit that controls currents through a plurality of LED strings used in one or more LED lamps disclosed herein.
Figure 9:
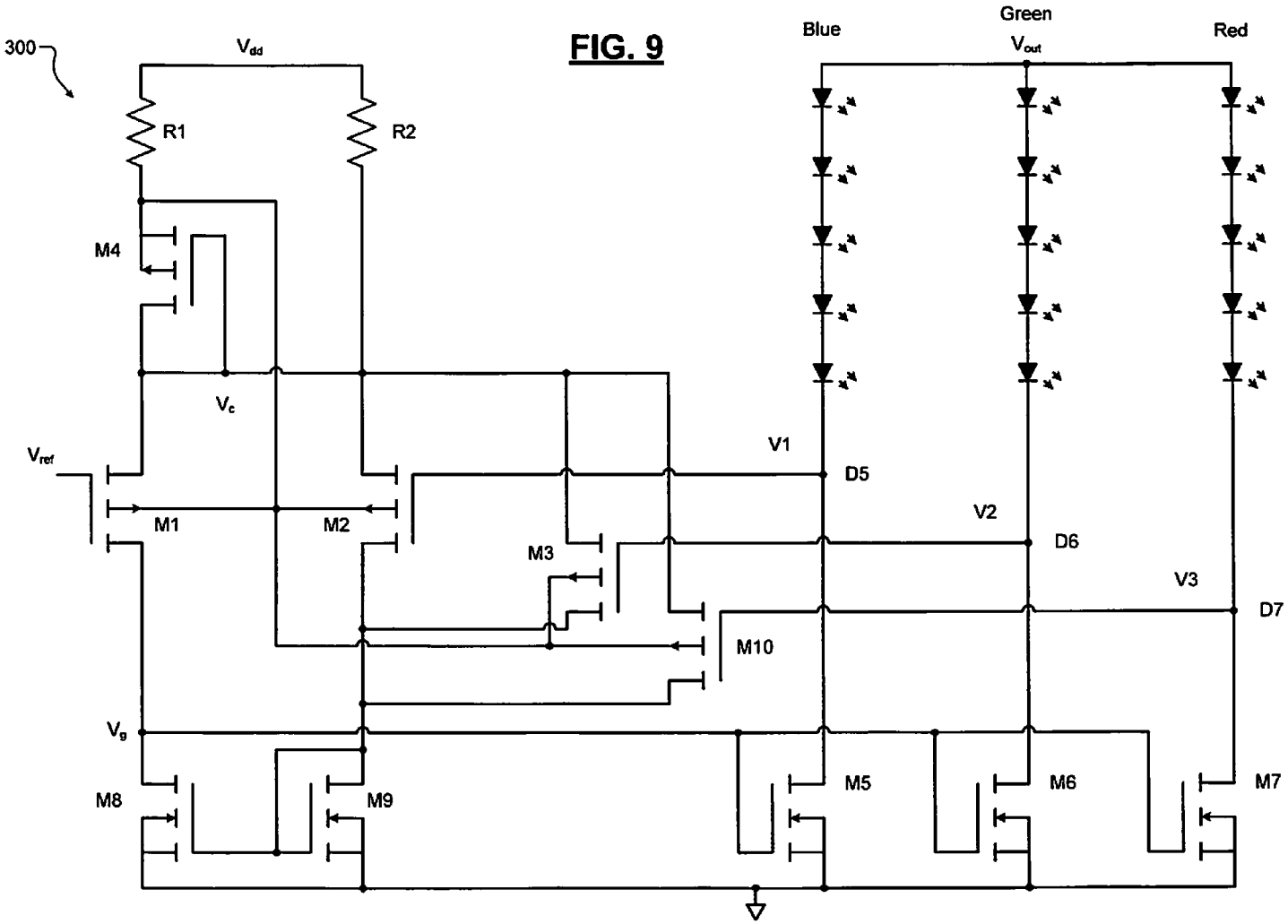
FIG. 9 is a schematic of a current balancing circuit that uses current mirroring and feedback to control currents through a plurality of LED strings used in one or more LED lamps according to the present disclosure.
Figure 10:
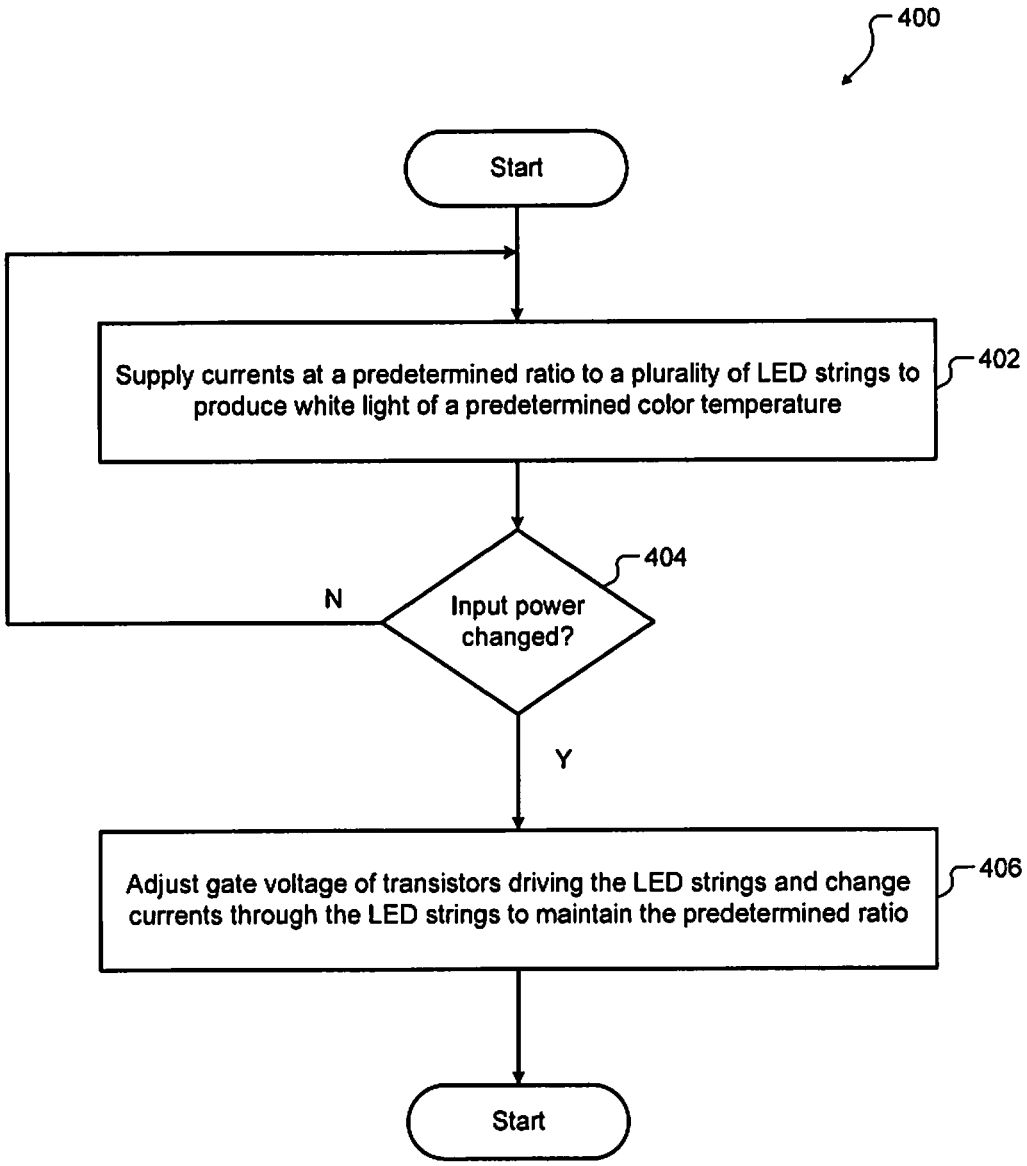
FIG. 10 is a flowchart of a method for controlling current through a plurality of LED strings in one or more LED lamps according to the present disclosure.

The disclosure is organized as follows. Before discussing the current balancing circuits, in FIGS. 1-6B, examples of LED-based lamps where the current balancing circuits can be used are described. Specifically, in FIGS. 1 and 2, a general LED-based lamp according to the present disclosure is described. In FIGS. 3A-4B, an LED-based lamp that has a shape of a conventional light bulb and that comprises a color temperature control switch according to the present disclosure is described. In FIGS. 5A and 6B, an LED-based lamp for illuminating large areas (e.g., a LED-based tube light) comprising a color temperature control switch according to the present disclosure is described. In FIG. 7, a general current balancing circuit that uses current mirroring and feedback to balance currents through two loads is described. For example, the two loads may include two strings of LEDs respectively producing light of two different colors that combines to generate white light. In FIG. 8, a current mirror circuit that uses current mirroring to balance currents through a plurality of LED strings is described. In FIG. 9, a current balancing circuit that uses current mirroring and feedback to balance currents through a plurality of LED strings is described. In FIG. 10, a method for controlling current through a plurality of LED strings in one or more LED lamps is described. In FIGS. 11A-12B, additional arrangements of LEDs and phosphors are shown.

Referring now to FIG. 1, an LED lamp 100 according to the present disclosure is shown. The LED lamp 100 includes a power converter module 102 and a set of LEDs 104. The power converter module 102 converts AC power to DC power. The power converter module 102 supplies the DC power to the LEDs 104.

The LEDs 104 may include a plurality of strings of LEDs. A detailed discussion of the plurality of strings of the LEDs 104 follows with references to FIGS. 4 and 6. Each string of LEDs may include a set of LEDs connected in series as shown in FIGS. 4 and 6. For example, as shown in FIG. 4, the LEDs 104 may include a first string of blue LEDs, a second string of blue LEDs coated with a green phosphor, and a third string of LEDs coated with a red phosphor.

In lamps using three LED strings as shown in FIG. 4 (e.g., see FIG. 3A), the first string of blue LEDs may not be coated with a phosphor that converts blue light to a light of a different color. Alternatively, the first string of blue LEDs may be coated with an amber phosphor. The amber phosphor may convert a portion of the blue light emitted by the third string of blue LEDs to red light and allow a remainder of the blue light emitted by the third string of blue LEDs to escape unconverted. The green and red light generated by the second and third strings of LEDs and the blue (and red) light generated by the first string of LEDs combine to generate white light.

Alternatively, as shown in FIG. 6, the LEDs 104 may include first and second strings of blue LEDs. In lamps using the LED strings shown in FIG. 6 (e.g., see FIGS. 5A and 5B), a glass surface may be coated with green and red phosphors to convert the blue light emitted by the first and second strings of LEDs respectively to green and red light. The LEDs and the coatings of green and red phosphors are arranged in a manner to allow some of the blue light emitted by the LEDs in the first and second strings to escape unconverted by the green and red phosphors. The green and red light generated by the first and second strings of LEDs combines with the blue light that escapes unconverted to generate white light.

Figure 2:
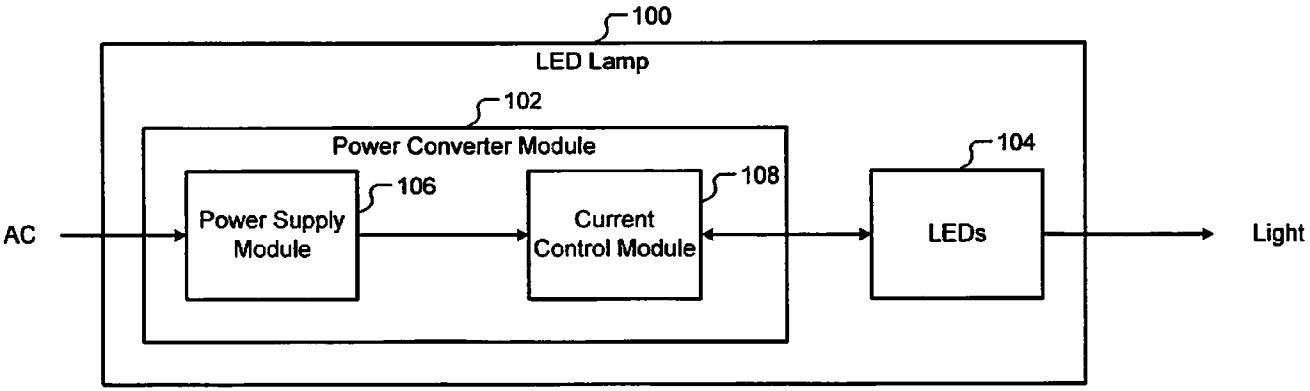
FIG. 2 is a detailed functional block diagram of the LED-based lamp of FIG. 1 according to the present disclosure.

Referring now to FIG. 2, the power converter module 102 may include a power supply module 106 and a current control module 108. The power supply module 106 converts the AC power to the DC power. For example, the power supply module 106 may include a switched-mode power supply that converts the AC line voltage to a DC voltage and a DC-to-DC converter that converts the DC voltage to a voltage $V_{out}$ suitable to power the LEDs 104.

The current control module 108 controls current through the LEDs 104. The current control module 108 uses one of the current balancing circuits according to the present disclosure to control current through the LEDs 104. The amount of current supplied to the LEDs 104 may be predetermined. For example, the amount of current supplied to each LED string may be predetermined to produce light having a predetermined whiteness (also called color temperature). The predetermined current may be programmed in the current control module 108 at the time of manufacture. However, according to the present disclosure, the total current is not controlled by the current control module 108. Instead, a current balancer divides the incoming current to the multiple LED strings in a predetermined ratio. The ratio is fixed at the time of manufacture to produce white light of desired color temperature.

In some implementations, the current control module 108 may receive feedback from the LEDs 104. For example, the feedback may include voltages across the plurality of strings of the LEDs 104. Based on the feedback, the current control module 108 may change the current through one or more strings of the LEDs 104 to maintain the predetermined whiteness of the light.

In some implementations, the current control module 108 may receive an input from a user-controllable switch located on the LED lamp 100. For example, when the LED lamp 100 has the shape of a standard light bulb that screws into a receptacle, a switch may be located at a base portion of the LED lamp 100, which screws into the receptacle. When the LED lamp 100 has the shape of a tube light or any other large area lamp, the switch may be located on a lamp holder, a base portion, or any other suitable location on the LED lamp 100. Based on the input, the current control module 108 may change the whiteness (i.e., color temperature) of the white light produced by the LEDs 104.

For example, using the switch, the user may select one of four color temperatures (in degrees Kelvin): 4000K, 3500K, 3000K, and 2700K. Additionally, the user may be able to select any value between 4000K and 2700K. White light in the 3500-4000K temperature range is called neutral white light. White light in the 2700-3000K temperature range is called warm white light. Warm white light has a yellow hue. White light in the 4500-5500K temperature range is called cool white light. Cool white light has a bluish hue. Using the switch, the user can change the color temperature of the white light generated by the LED lamp 100 without changing the LED lamp 100.

Figure 3A:
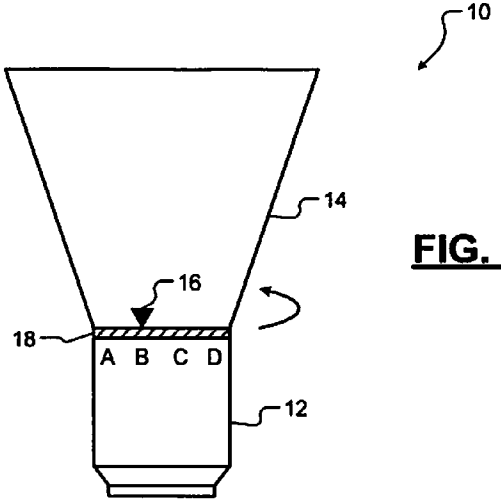
FIG. 3A depicts a LED lamp having the shape of a conventional light bulb that uses LEDs according to the present disclosure.
Figure 3B:
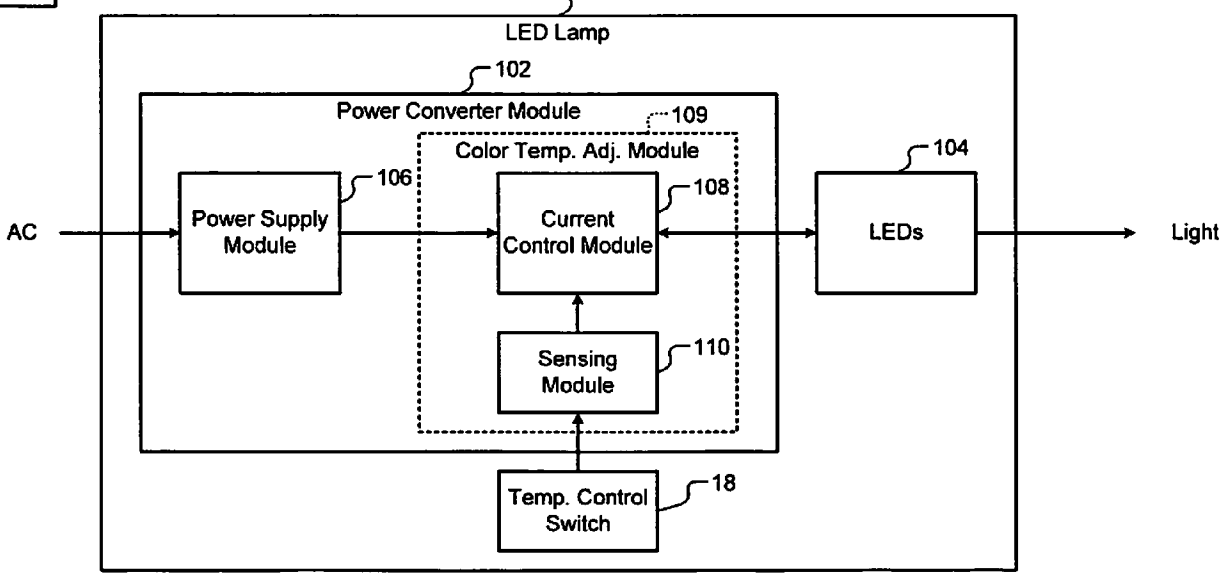
FIG. 3B is a functional block diagram of the LED lamp of FIG. 3A.

Referring now to FIGS. 3A and 3B, an example of an LED lamp 10 comprising a temperature control switch according to the present disclosure is shown. In FIG. 3A, the LED lamp 10 includes a base portion 12 and a light dispersing portion 14. The base portion 12 screws into a receptacle. The light dispersing portion 14 includes the power control module 102, the LEDs 104, and an optical reflector assembly (not shown). The portions 12 and 14 are a single piece. A small ring 18 is mounted around the neck of the LED lamp 10. The ring 18 slides over the body of the LED lamp 10. The ring 18 is connected to a switch inside the body of the LED lamp 10 to control the whiteness (i.e., the color temperature) of the light output by the LED lamp 10. Hereinafter the ring 18 and the switch are collectively referred to as the temperature control switch 18.

For example, the temperature control switch 18 can have one of a plurality of states (e.g., A, B, C, or D). Each state can correspond to a different color temperature between 2700 and 5500 degrees Kelvin. The states can be marked on the base portion 12, and an indicator 16 on the light dispersing portion 14 can indicate the state selected by rotating the light dispersing portion 14. Alternatively, the indicator 16 can be located on the base portion 12, and the markings of the states can be located on the light dispersing portion 14. By rotating the temperature control switch 18 to different positions, the user can select different color temperatures.

The power converter module 102 is included in the light dispersing portion 14 of the LED lamp 10. In some implementations, the power converter module 102 may be included in the base portion 12 of the LED lamp 10 instead of in the light dispersing portion 14 of the LED lamp 10. The power converter module 102 senses a state of the temperature control switch 18. Based on the state of the temperature control switch 18, the power converter module 102 adjusts the DC power supplied to the LEDs 104.

In FIG. 3B, a functional block diagram of an LED lamp 10 comprising a temperature control switch according to the present disclosure is shown. The LED lamp 10 includes the power converter module 102, the LEDs 104, and the temperature control switch 18. The power converter module 102 includes the power supply module 106 and a color temperature adjustment module 109. The color temperature adjustment module 109 includes the current control module 108 and a sensing module 110.

The color temperature adjustment module 109 adjusts or varies outputs of the first, second, and third sets of LEDs 104 according to a color temperature selected by a user using the temperature control switch 18. For example, the current control module 108 adjusts or varies currents through the first, second, and third sets of LEDs 104 according to a color temperature selected by a user using the temperature control switch 18. While current control is described as a way of adjusting or varying outputs of the first, second, and third sets of LEDs 104, other ways (e.g., voltage control, power control, and so on) may be used to adjust or vary outputs of the first, second, and third sets of LEDs 104.

The sensing module 110 senses the state of the temperature control switch 18 selected by the user. Based on the sensed state, the power converter module 102 selects a corresponding color temperature and adjusts the DC power supplied to the LEDs 104. Specifically, the sensing module 110 outputs a signal to the current control module 108 based on the sensed state. The current control module 108 controls current through the LEDs 104 according to the sensed state to output white light having a corresponding color temperature.

For example, the current control module 108 may select currents through the LED strings having a first proportion when the temperature control switch 18 is in a first position, a second proportion when the temperature control switch 18 is in a second position, and so on. For example, currents through first, second, and third strings may be in proportion X1:Y1:Z1 when the temperature control switch 18 is in the first position; X2:Y2:Z2 when the temperature control switch 18 is in the second position; and so on. X1, Y1, Z1, X2, Y2, Z2, and so on are numbers. For example, X1:Y1:Z1 may be 1:2:3; X2:Y2:Z2 may be (1.1): (2.4): (3.8); and so on. For example, X1:Y1:Z1 may be 1:2:3; X2:Y2:Z2 may be (0.9): (2.2): (3.6); and so on.

Referring now to FIG. 4, an example of a plurality of strings of the LEDs 104 using in the LED lamp 10 is shown. For example only, three strings: a first string 112, a second string 114, and a third string 116 are shown. For example, the first string 112 may include blue LEDs without a phosphor coating to convert blue light into a light of a different color; the second string 114 may include blue LEDs with a coating of green phosphor; and the third string 116 may include blue LEDs with a coating of red phosphor. Additional or fewer strings having LEDs coated with different phosphors may be used. Multiple strings (e.g., two or more strings) of each of the first string 112, the second string 114, and the third string 116 may be used. For example only, five LEDs are shown in each LED string. Fewer or more than five LEDs may be used in each LED string.

In some implementations, LEDs in the first string 112 may be coated with an amber phosphor. The current control module 108 controls currents through the first string 112, the second string 114, and the third string 116 to generate white light having a desired whiteness (i.e., color temperature).

The LEDs in the first string 112 may emit blue light having a set of wavelengths approximately around 450 nm (e.g., between 450-470 nm). The LEDs in the second string 114 may emit blue light having wavelengths less than 450 nm. The LEDs in the third string 116 may emit blue light having wavelengths greater than 470 nm. The blue LEDs producing blue light having the highest wavelength (e.g., greater than ~470 nm) should be used with red/amber phosphor to minimize losses due to Stokes' shift. Similarly, the blue LEDs producing blue light having lower wavelengths are to be used with green phosphor.

The currents supplied by the current control module 108 determine the amount of blue (and red) light generated by the LEDs in the first string 112, the amount of green light generated by the LEDs in the second string 114, and the amount of red light generated by the LEDs in the third string 116. The current control module 108 may reduce the amount of current through the third string 116 in proportion to the amount of red light produced by the LEDs in the first string 112 when coated with the amber phosphor.

Additionally, the current control module 108 may adjust the proportion of currents through the first string 112, the second string 114, and the third string 116 depending on the color temperature selected by the user. The blue (and red) light output by the LEDs in the first string 112, the green light output by the LEDs in the second string 114, and the red light output by the LEDs in the third string 116 combine to generate white light of desired whiteness.

In some implementations, a brightness control (e.g. a dimmer switch) may be connected to the LED lamp 10. The power converter module 102 may receive the AC power according to a setting of the dimmer switch. The power supply module 106 may output different amounts of DC power based on the settings of the dimmer switch. Based on the amount of DC power received from the power supply module 106, the current control module 108 may change currents through one or more strings of the LEDs 104. The brightness of the white light output by the LEDs 104 may change based on the changes in the currents through the LEDs 104.

The current control module 108 may change currents through one or more strings of the LEDs 104 according to a dimmer variable (e). For example, the currents through one or more strings of the LEDs 104 may be in proportion X1:Y1:Z1. For example, the current control module 108 may change currents through one or more strings of the LEDs 104 from 0.5:0.5:0.5 to 1.5:1.5:1.5.

Figure 5B:
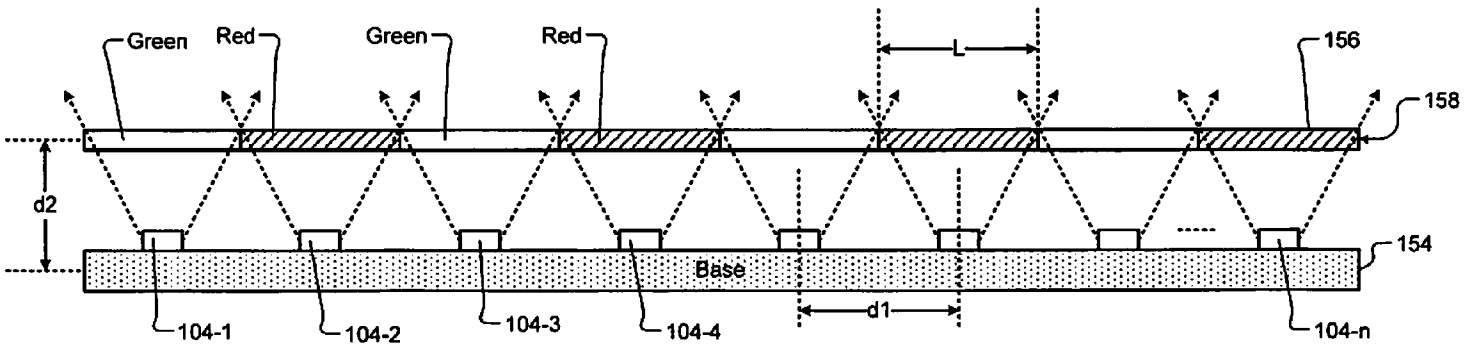
FIG. 5B depicts the LED and phosphor layouts of the LED lamp of FIG. 5A.

Referring now to FIGS. 5A and 5B, an example of an LED lamp 150 for illuminating large areas according to the present disclosure is shown. For example only, the LED lamp 150 having the shape of a tube light is shown. The teachings disclosed herein with reference to the LED lamp 150 can be applied to any LED lamp used to illuminate large areas.

In FIG. 5A, the LED lamp 150 includes a base portion 154 and a glass layer 156. LEDs 104 are arranged on the base portion 154 as described below in detail. An inner surface of the glass layer 156 that faces the LEDs 104 is coated with phosphors 158 as explained below in detail. The base portion 154 and the glass layer 156 terminate on either side in a lamp holder 160. Each lamp holder 160 connects to a receptacle via bi-pin fittings 162. The base portion 154 includes the power converter module 102. The power converter module 102 is connected to the bi-pin fittings 162. The power converter module 102 receives AC power via the bi-pin fittings 162. The power converter module 102 converts AC power into DC power and supplies the DC power to the LEDs 104. A transparent or opaque material 157 may be used to cover the glass layer 156. In some implementations, instead of the glass layer 156, a layer of any other suitable (e.g., transparent) material may be used.

In FIG. 5B, the placement of the LEDs 104 and phosphors 158 is shown in detail. A plurality of LEDs 104-1, 104-2, . . . , **104-*n* (collectively LEDs 104), where n is an integer greater than 1, is arranged on the base portion 154. The LEDs 104** include two sets of LEDs. A first set of LEDs generates blue light having a first wavelength. A second set of LEDs generates blue light having a second wavelength. For example only, the first wavelength is less than or equal to 450 nm, and the second wavelength is greater than or equal to 470 nm. In some implementations, the first wavelength may be 450 nm±X nm, and the second wavelength may be 470 nm±X nm, where $0 \leq X \leq 20$, for example. The number X can also be greater than 20.

The LEDs 104 in the first and second sets are evenly spaced and arranged in an alternating pattern along a straight line on the base portion 154. For example, the LEDs 104-1, 104-3, and so on belong to the first set of LEDs; and the LEDs 104-2, 104-4, and so on belong to the second set of LEDs. The LED 104-1 is separated by a distance d1 from the LED 104-2; the LED 104-2 is separated by the distance d1 from the LED 104-3; and so on.

The inner surface of the glass layer 156 facing the LEDs 104 includes a plurality of coatings of phosphors 158. For example, the coatings of phosphors 158 include coatings of green and red phosphors. Each coating of green and red phosphors may be of a length L. In some implementations, the coatings of green and red phosphors may have different lengths. The coatings of green and red phosphors are arranged in an alternating pattern along a straight line on the inner surface of the glass layer 156. While the coatings of green and red phosphors are contiguous, in some implementations, the coatings may be separated by a gap. Centers of the green phosphors are aligned with centers of the first set of LEDs. Centers of the red phosphors are aligned with centers of the second set of LEDs. The glass layer 156 is separated by a distance d2 from the base portion 154.

The green phosphors convert some of the blue light emitted by the first set of LEDs to green light. The red phosphors convert some of the blue light emitted by the second set of LEDs to red light. Some of the blue light emitted by the first and second set of LEDs escapes the phosphors 158 unconverted. The placement of the LEDs 104 and the phosphors 158 described above allows a first portion of the blue light emitted by the LEDs 104 to be converted by the phosphors 158 to green and red light and allows a second portion of the blue light emitted by the LEDs 104 to escape unconverted. The green light, the red light, and the escaped blue light combine to form white light.

The amount of blue light that escapes the phosphors 158 may depend on various factors. For example, the factors may include values of the first and second wavelengths, a density of coatings of the green and red phosphors 158, the length L of each coating of the green and red phosphors 158, a length of a gap between adjacent phosphor coatings, the distance d1 between the LEDs 104, the distance d2 between the base portion 154 and the glass layer 156, and so on. The uniformity of the white light across the LED lamp 150 may also depend on one or more of these factors.

A functional block diagram of the LED lamp 150 shown in FIGS. 5A and 5B is similar to the functional block diagram of the LED lamp 10 shown in FIG. 3B and is therefore not shown and described again to avoid repetition.

Referring now to FIG. 6, an example of a plurality of strings of the LEDs 104 used in the LED lamp 150 is shown. For example only, two strings: a first string 114 and a second string 116 are shown. For example only, five LEDs are shown in each LED string. Fewer or more than five LEDs may be used in each LED string. For example, the first string 114 may include LEDs that emit blue light having the first wavelengths, and the second string 116 may include LEDs that emit blue light having the second wavelengths. For example, the LEDs in the first string 114 may emit blue light having a set of wavelengths approximately around 450 nm (e.g., 450 nm±X nm). The LEDs in the second string 116 may emit blue light having a set of wavelengths approximately around 470 nm (e.g., 470 nm±X nm). For example only, 0≤X≤20, for example. The number X can also be greater than 20.

The currents supplied by the current control module 108 determine the amount of blue light generated by the LEDs in the first string 114 and the second string 116. The current control module 108 may adjust the proportion (i.e. ratio) of currents through the first string 114 and the second string 116 depending on the color temperature selected by the user. The blue light output by the LEDs in the first string 114 and the second string 116 is partly converted by the phosphors 158 into green and red light and partly allowed to escape unconverted. The green and red light converted by the phosphors 158 combines with the unconverted blue light to generate white light of desired whiteness.

In some implementations, a brightness control (e.g. a dimmer switch) may be connected to the LED lamp 150. The power converter module 102 may receive the AC power according to a setting of the dimmer switch. The power supply module 106 may output different amounts of DC power based on the settings of the dimmer switch. Based on the amount of DC power received from the power supply module 106, the current control module 108 may change currents through one or more strings of the LEDs 104. The brightness of the white light output by the LEDs 104 may change based on the changes in the currents through the LEDs 104.

Referring now to FIG. 7, a current balancing circuit 200 according to the present disclosure is shown. The current balancing circuit 200 maintains currents through multiple loads at a predetermined proportion (i.e., ratio). For example only, the current balancing circuit 200 is shown to include only two loads, L1 and L2. The current balancing circuit 200, however, can maintain currents through any number of loads at a predetermined proportion. Further, while the current balancing circuit 200 is discussed herein with reference to LED strings as loads, the current balancing circuit 200 can be used to balanced currents through other loads.

The current balancing circuit 200 senses a change in current through one of the loads and adjusts currents through the other load(s) so that the currents through the loads are in a predetermined proportion despite the change in current through one of the loads. For example, if the loads receive more (or less) power (e.g., $V_{out}$ from the power supply module 106), the current balancing circuit 200 increases (or decreases) currents through the loads to maintain the currents at the predetermined proportion. When the loads include LED strings that output light of different colors to produce white light, the current balancing circuit 200 maintains the proportion of the currents through the LED strings to the predetermined ratio regardless of changes in brightness made by a user. The current balancing circuit 200 maintains the ratio of the currents. The color of the light produced depends on other factors as well.

The current balancing circuit 200 comprises transistors M1-M8, loads 11 and L2, and resistors R1 and R2 connected as shown in FIG. 7. The loads 11 and L2 are respectively connected to drains D5 and D6 of the drivers M5 and M6. The gates of the drivers M5 and M6 are connected to an output of a comparator comprising transistors M1, M2, and M3. Transistors M7 and M8 form a current mirror. The current mirror is connected to the comparator as shown. For example only, the loads L1 and L2 may respectively include two strings of LEDs configured to generate light of two different colors that combines to produce white light of a predetermined color temperature (e.g., see FIG. 6). While not shown, additional loads and drivers may be added, and the comparator may be modified accordingly. (For example, see FIG. 9.)

The current balancing circuit 200 compares the lowest of the voltages V1 or V2 at the drains D5 and D6 of the transistors M5 and M6 to a reference voltage $V_{ref}$. The voltages V1 and V2 are kept substantially equal to or above at least a certain value, such that currents through the transistors M5, M6, M7, and M8 are matched to the best possible accuracy. Even with perfectly matched transistors M5 and M6, if there is difference in the loads L1 and L2, the difference might cause the voltages V1 and V2 to be different from each other. By controlling a gate voltage $V_g$ of the transistors M5 and M6, the current balancing circuit 200 ensures that both the voltages V1 and V2 are at least $V_{ref}$.

If voltages V1 and V2 at the drains D5 and D6 of the transistors M5 and M6 closely match, currents through the transistors M5 and M6 (and hence through the loads L1 and L2) are proportional to respective areas of transistors M5 and M6. The comparator compares the lowest of the voltages V1 and V2 at the drains D5 and D6 to the reference voltage $V_{ref}$. The voltages V1 and V2 at the drains D5 and D6 may become different due to a change in current through one of the loads. For example, current through one of the loads may change due to a change in $V_{out}$ delivered by the power converter module 102 when a user changes brightness level. The comparator adjusts the gate voltage $V_g$ of the transistors M5 and M6 until the voltages V1 and V2 at the drains D5 and 06 are at least $V_{ref}$. This makes the ratio of currents through the loads L1 and L2 proportional to the ratio of the areas of the transistors M5 and M6. When V1 or V2 changes, the comparator compares the lowest of the voltages V1 or V2 to $V_{ref}$ and generates $V_g$ based on the comparison. $V_g$ drives the gates of M5 and M6 to change currents through the loads L1 and L2 so that the currents are proportional to the ratio of the areas of the transistors M5 and M6. When the output voltage $V_{out}$ across the loads changes (e.g., due a change in the brightness level by a user), the current balancing circuit 200 adjusts the currents through the loads L1 and L2 to maintain the currents at a predetermined ratio.

For example, suppose that current through one of the loads L1 or L2 decreases due to a change in brightness level by the user. Due to a decrease in current through load L1 or L2, the voltage V1 or V2 decreases. If the voltage V1 at D5 decreases, more current flows into transistor M2. If the voltage V2 at D6 decreases, more current flows into transistor M3. If current through transistor M2 or M3 increases, current through transistor M7 increases. Due to current mirroring, current through transistor M8 increases. The increased current through transistor M8 pulls the gates of transistors M5 and M6 to a lower voltage $V_g$. Lowering the voltage $V_g$ at the gates of transistors M5 and M6 decreases currents through the loads connected to the respective drains.

In this manner, if current through the load L1 changes, the current balancing circuit 200 changes the current through the load L2 to track the change in current through the load L1. If current through the load L1 increases (or decreases), the current balancing circuit 200 adjusts the gate drive $V_g$ of the transistors M5 and M6 to increase (or decrease) current through the load L2 in the same proportion. Accordingly, the ratio of currents through the loads L1 and L2 is maintained at a predetermined value. Consequently, the color temperature of the white light output by the LEDs (loads L1 and L2) is maintained at a predetermined value.

Referring now to FIG. 8, an example of a current mirror circuit 250 that drives three strings of LEDs is shown. Suppose that the three LED strings respectively produce blue, green, and red light that combines to generate white light. The current mirror circuit 250 includes transistors M5, M6, and M7 that respectively drive the three LED strings. The current mirror circuit 250 controls the ratio of currents through the three LED strings proportional to the area of the transistors M5, M6, and M7. For example, if a proportion of the areas A1, A2, and A3 of the transistors M5, M6, and M7 is 1:2:3, the currents through the blue, green and red LED strings will be in the proportion 1:2:3.

To accurately control the proportion of currents, the drain voltages of the transistors M5, M6, and M7 need to closely match. If the three LED strings use pure blue, pure green, and pure red LEDs, the drain voltages of the transistors M5, M6, and M7 may not closely match due to differences in voltage/current characteristics of materials used to manufacture the pure blue, green, and red LEDs. Instead, if a combination of blue LEDs and phosphors is used in the three LED strings to generate blue, green, and red light, the voltage/current characteristics of the three LED strings will closely match since the blue LEDs in each string are made from the same material. Accordingly, the drain voltages of the transistors M5, M6, and M7 will closely match. For the same amount of current, the voltage across the LED strings will be similar, and hence the drain voltages of the transistors M5, M6, and M7 will be close to each other. Consequently, the proportion of currents through the three LED strings will be accurate.

When $V_{out}$ changes, however, the current mirror circuit 250 includes no feedback mechanism to detect changes in currents through the LED strings and to adjust gate drive (i.e., biasing) of the transistors M5, M6, and M7 based on the changes in $V_{out}$. Accordingly, the current mirror circuit 250 cannot adjust the gate drive of the transistors M5, M6, and M7 in response to changes in $V_{out}$. Consequently, when $V_{out}$ increases, the voltage drop across the transistors M5, M6, and M7 will increase resulting in an increase in power dissipation.

Further, to change brightness level, when reference current I1 is changed, the ratio of currents through the three LED strings may need to be changed. For example, for a first value of I1, currents through the three LED strings may need to have a ratio of X1:Y1:Z1 to produce white light of a predetermined color temperature (whiteness); for a second value of I1, currents through the three LED strings may need to have a ratio of X2:Y2:Z2 to produce white light of the predetermined color temperature; and so on. For example, the ratio X1:Y1:Z1 may be 1:2:3; and the ratio X2:Y2:Z2 may be 1:2:2, or 2:1:3, and so on. This is because the conversion efficiencies of the phosphors may differ at different currents. The ratio will need to be changed particularly if current through one of the three LED strings differs from currents through the other LED strings by a large amount (e.g., if the currents are in proportion 1:2:3). If the ratio is not changed when I1 is changed, the color temperature of the white light will change. Therefore, to get the desired color when I1 is changed, the ratio of the currents will need to be changed, particularly when current through one of the LED strings required to produce a predetermined whiteness differs largely from other currents required to produce the predetermined whiteness.

Referring now to FIG. 9, a current balancing circuit 300 includes a comparator and a current mirror to sense the drain voltages of the transistors M5, M6, and M7 and to adjust the gate voltage $V_g$ of the transistors M5, M6, and M7 when $V_{out}$ changes. The comparator and the current mirror of the current balancing circuit 300 are similar to the comparator and the current mirror of the current balancing circuit 200 shown in FIG. 7.

The current balancing circuit 300 increases the gate voltage $V_g$ of the transistors M5, M6, and M7 when $V_{out}$ increases. Increasing the gate voltage $V_g$ of the transistors M5, M6, and M7 in response to an increase in $V_{out}$ reduces power dissipation of the transistors M5, M6, and M7. Additionally, the current balancing circuit 300 decreases the gate voltage $V_g$ of the transistors M5, M6, and M7 when $V_{out}$ decreases. Decreasing the gate voltage $V_g$ of the transistors M5, M6, and M7 in response to a decrease in $V_{out}$ increases the drain voltages V1-V3 of the transistors M5, M6, and M7 to levels that are comparable to the reference voltage $V_{ref}$.

As explained with reference to FIG. 7, a comparator comprising transistors M1, M3, M3, and M10 compares voltages V1-V3 at the drains D5-D7 of the transistors M5-M7 to the reference voltage $V_{ref}$. When current through one of the three LED strings changes, the comparator and the current mirror comprising transistors M9 and M8 adjust the gate voltage $V_g$ (i.e., biasing) of the transistors M5-M7 to change the currents through the remaining LED strings to maintain a predetermined ratio of the currents through the three LED strings.

If the voltages V1-V3 at the drains D5-D7 of the transistors M5-M7 closely match, currents through the transistors M5-M7 (and hence through the three LED strings) are proportional to respective areas of transistors M5-M7. For example, if a proportion of the areas A1, A2, and A3 of the transistors M5, M6, and M7 is 1:2:3, the currents through the blue, green, and red LED strings will be in the proportion 1:2:3. The comparator compares the voltages V1-V3 at the drains D5-D7 to the reference voltage $V_{ref}$. The voltages V1-V3 at the drains D5-D7 may become different due to a change in current through one of the loads. For example, current through one of the loads may change due to a change in $V_{out}$ delivered by the power converter module 102 when a user changes brightness level. The comparator adjusts the gate voltage $V_g$ of the transistors M5-M7 until the lowest voltage of V1, V2, and V3 at the drains D5, D6, and 07 closely match the $V_{ref}$. This makes the ratio of currents through the three LED strings proportional to the ratio of the areas of the transistors M5-M7. When V1 or V2 or V3 changes, the comparator compares V1 or V2 or V3 is compared to $V_{ref}$ and generates $V_g$ based on the comparison. $V_g$ drives the gates of M5-M7 to change the currents through the three LED strings so that the currents are proportional to the ratio of the areas of the transistors M5-M7. When the output voltage $V_{out}$ across the three LED strings changes (e.g., due a change in the brightness level by a user), the current balancing circuit 300 adjusts the currents through the three LED strings to maintain the currents at a predetermined ratio.

For example, suppose the current through one of the three LED strings decreases due to a change in brightness level by the user. Due to a decrease in current through one of the three LED strings, the voltage V1 or V2 or V3 decreases. If the voltage V1 at D5 decreases, more current flows into transistor M2. If the voltage V2 at D6 decreases, more current flows into transistor M3. If the voltage V3 at D7 decreases, more current flows into transistor M10. If current through transistor M2 or M3 or M10 increases, current through transistor M9 increases. Due to current mirroring, current through transistor M8 increases. The increased current through transistor M8 pulls the gates of transistors M5-M7 to a lower voltage $V_g$. Lowering the voltage $V_g$ at the gates of transistors M5-M7 decreases currents through the three LED strings connected to the respective drains.

In this manner, if the total current through the three LED string changes, the current balancing circuit 300 changes the currents through one or more of the three LED strings to track the change. Accordingly, the ratio of currents through the three LED strings is maintained at a predetermined value. Consequently, the color temperature of the white light output by the three LED strings is maintained at a predetermined value.

In one implementation, for example, the currents through the three LED strings required to produce white light of a predetermined color temperature may be known during manufacture. If the currents through the three LED strings are vastly different (e.g., if the currents through the red, green, and blue LED strings are in a ratio 3:2:1), the transistors M5-M7 can be designed to have area with the same ratio as the currents. Accordingly, for the same gate drive $V_g$, the drain voltages of the transistors M5-M7 will closely match. For example, the transistor M7 driving the LED string producing red light at 180 mA will have the same drain voltage as the transistor M6 driving the LED string producing green light at 120 mA and the transistor M5 driving the LED string producing blue light at 60 mA.

Alternatively, the LEDs may be designed so that the area of the transistors M5-M7 and currents through the three LED strings can be equal, and the drain voltages of the transistors M5-M7 closely match. For example, suppose that 180, 120, and 60 units of red, green, and blue light are respectively required to produce white light of a predetermined color temperature. The LED string producing pure red light may be supplied less current (e.g., 120 mA instead of 180 mA) to produce only 120 units of red light instead of producing 180 units of red light. Additionally, the LEDs in the blue string producing blue light may be coarsely coated with amber or red phosphor so that half of the blue light is converted to red light and half of the blue light escapes unconverted. The LED string producing a mixture of red and blue light may be supplied a higher current (e.g., 120 mA instead of 60 mA) to produce 120 units of light including 60 units each of red and blue light. The LED string producing pure green light may be supplied the same current as the other LED strings (e.g., 120 mA) to produce 120 units of green light. In this manner, all three LED strings can be supplied with the same current (e.g., 120 mA) and can produce the required amounts of red, green, and blue light to produce white light of desired whiteness. The transistors M5-M7 can have the same area and produce drain voltages that closely match.

In illumination systems using AC-to-DC converters, a brightness control signal (also called dimming signal) is typically provided by the primary side (the AC side). Communicating the dimming signal from the primary side to the secondary side (where the current balancing circuit operates) can be difficult due to isolation between the primary and secondary sides and due to safety standards and regulations. Often additional circuitry is required to communicate the dimming signal from the primary side to the secondary side.

The current balancing circuits disclosed herein do not require the dimming signal to be transmitted from the primary side. Instead, when the primary side delivers more current than the total current in the LED strings (e.g., 180+120+60=360 mA in the above example), the output voltage $V_{out}$ increases. The current balancing circuit adjusts the gate drive of the transistors driving the LED strings to increase the currents through the LED strings and maintains the ratio between the currents to output white light of the desired color temperature.

Referring now to FIG. 10, a method 400 for balancing currents through LED strings according to the present disclosure is shown. At 402, control supplies current at a predetermined ratio to a plurality of LED strings to produce white light of a predetermined color temperature. At 404, control determines whether input power to the plurality of LED strings has changed. At 406, if the input power to the plurality of LED strings has changed, control adjusts gate voltages of transistors that drive the LED strings and changes currents through the LED strings to maintain the predetermined ratio between the currents. Accordingly, control maintains the predetermined color temperature of the white light produced by the plurality of LED strings regardless of changes in the input power to the plurality of LED strings.

In one application, the current balancing disclosed herein is used to manage the distribution of the blue spectrum. In particular, the human eye is sensitive only to a certain range of blue wavelengths. For example, the human is not very sensitive to blue wavelengths of less than or equal to 450 nm. Rather, the human eye sees normal blue at approximately 470 nm. Accordingly, blue LEDs producing blue light having wavelengths of about 470 nm are used to produce blue light, and blue LEDs producing blue light of other wavelengths are used to convert to green and red light. For example, the blue LEDs producing blue light having wavelengths between 440 and 460 nm can be used to convert to green light, and the blue LEDs producing blue light having wavelengths greater than 470 nm can be used to convert to red light.

White light can be generated in different ways. For example, white light can be generated using a combination of blue light generated by blue LEDs, and blue light converted to green and red light. Alternatively, white light can also be generated using a combination of blue light and blue light converted to yellow and reddish yellow light.

Since human eye is sensitive to variations in wavelength in a certain range of the blue spectrum, blue light used in producing white light need not be generated using LEDs that produce blue light. Instead, blue light used in producing white light can be generated by converting ultraviolet light to broadband blue light. Only a small amount of ultraviolet light needs to be converted to blue light since only a small amount of blue light (e.g., 5-10%) is needed to produce white light. Other colors needed to produce white light, such as green, red, yellow, or reddish yellow, can be generated by converting blue light produced by blue LEDs having varying wavelengths (and therefore varying shades of blue) in the blue spectrum.

Thus, blue light in the entire range of the blue spectrum (i.e., light produced by blue LEDs having all the blue wavelengths) is used to convert to one or more of the other colors, and none of the blue color generated by the blue LEDs is used in producing white light. Accordingly, when blue LEDs are manufactured, blue LEDs that produce blue light having wavelengths that are useful and/or optimal in some applications (e.g., 470 nm) can be sold and utilized in those applications, and blue LEDs that produce blue light having other varying wavelengths in the not so useful or suboptimal range can be used to convert to other colors used in producing white light. This improves the yield of blue LEDs in the manufacturing process, and minimizes the percentage of the manufactured blue LEDs that are not utilized.

Further, blue LEDs can be optimized to produce blue light having wavelengths to which human eye is not very sensitive (e.g., from 440 to 460 nm). For example, blue LEDs can be optimized to generate blue light having a wavelength of 450 nm. Blue LEDs producing blue light having not so useful or suboptimal wavelengths in the blue spectrum (e.g., 430 to 460 nm), to which human eye is not very sensitive, can be utilized to convert to green or red or other colors. One or more of these colors can be combined with the blue light generated by converting ultraviolet light to produce white light. In other words, blue LEDs can be intentionally manufactured to produce blue light having not so useful or suboptimal wavelengths in the blue spectrum (e.g., 430 to 460 nm).

Figure 11A:
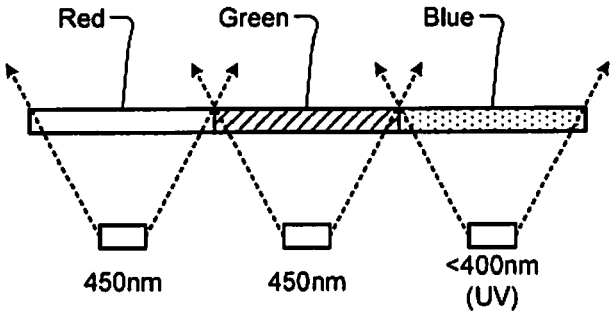
FIGS. 11A-11C depicts additional ways of generating white light using blue LEDs, ultraviolet LEDs, and phosphors according to the present disclosure.

Referring now to FIGS. 11A-11D, different ways of producing white light having different whiteness (i.e., different color temperatures) are shown. In FIG. 11A, blue light emitted by blue LEDs having wavelength of about 450 nm (for example) can be converted to red and green light using red and green phosphors. Ultraviolet light emitted by ultraviolet LEDs having wavelength of less than or equal to 400 nm can be converted to blue light using the blue phosphor. The red, green, and blue light can be combined to produce white light. Current through the LEDs used to generate one or more of red, green, and blue color can be adjusted to adjust the color temperature of the white light.

Figure 11B:
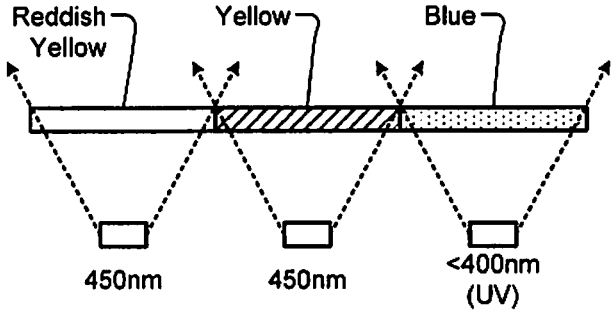

In FIG. 11B, blue light emitted by blue LEDs having wavelength of about 450 nm (for example) can be converted to reddish yellow and yellow light using reddish yellow and yellow phosphors. Ultraviolet light emitted by ultraviolet LEDs having wavelength of less than or equal to 400 nm can be converted to blue light using the blue phosphor. The reddish yellow, yellow, and blue light can be combined to produce white light. Current through the LEDs used to generate one or more of reddish yellow, yellow, and blue color can be adjusted to adjust the color temperature of the white light.

Figure 11C:
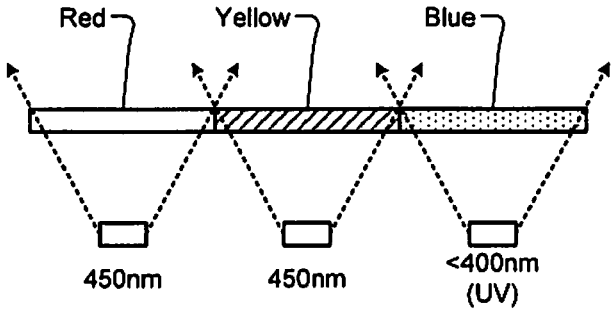

In FIG. 11C, blue light emitted by blue LEDs having wavelength of about 450 nm (for example) can be converted to red and yellow light using red and yellow phosphors. Ultraviolet light emitted by ultraviolet LEDs having wavelength of less than or equal to 400 nm can be converted to blue light using the blue phosphor. The red, yellow, and blue light can be combined to produce white light. Current through the LEDs used to generate one or more of red, yellow, and blue color can be adjusted to adjust the color temperature of the white light.

Figure 11D:
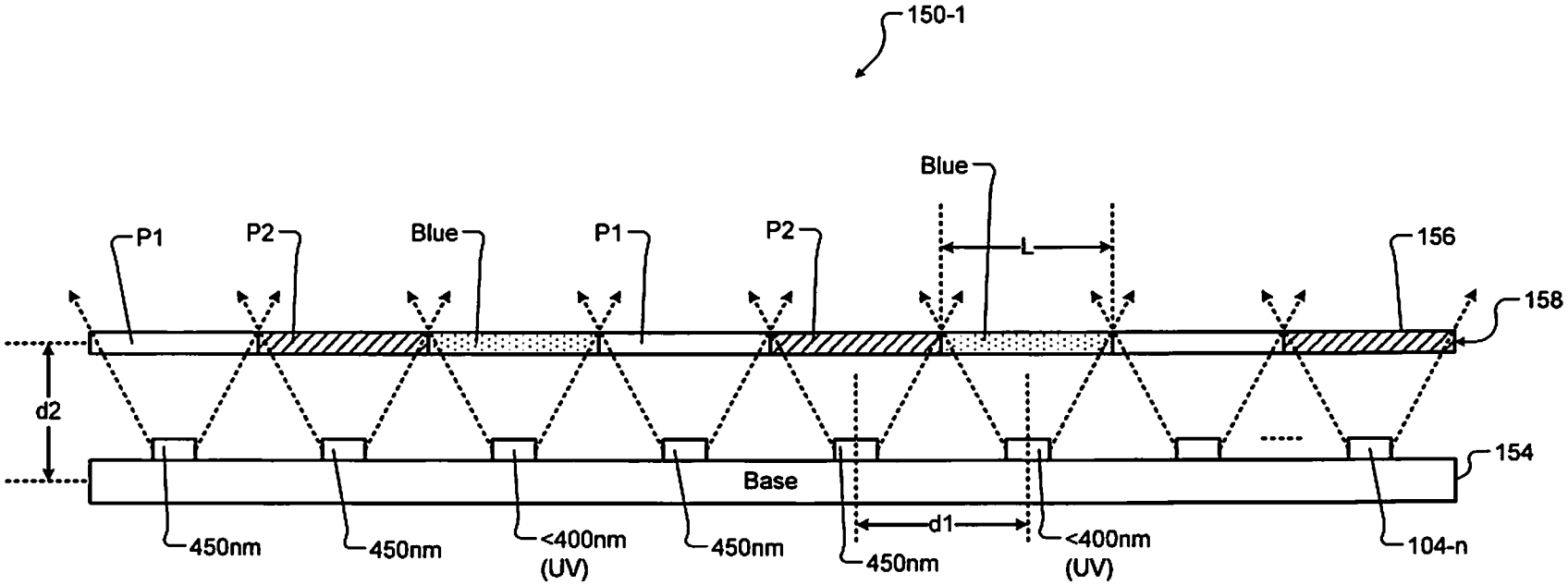
FIG. 11D depicts LED and phosphor layouts of an LED lamp having the shape of a conventional tube light that uses one of the additional ways of generating white light shown in FIGS. 11A-11C.

In FIG. 11D, an LED lamp 150-1, which is a variation of the LED lamp 150 shown in FIG. 5A, utilizes blue LEDs and different phosphors to generate light of different colors other than blue, and utilizes ultraviolet LEDs and blue phosphors to generate blue light as shown in FIGS. 11A-11C. Further, the LED lamp 10 shown in FIG. 3A can utilize blue LEDs and different phosphors to generate light of different colors other than blue, and utilize ultraviolet LEDs and blue phosphors to generate blue light as shown in FIGS. 11A-11C. For example, in FIG. 4, the LED string 112 can include ultraviolet LEDs coated with blue phosphor, the LED string 114 can include blue LEDs coated with phosphor P1, and the LED string 116 can include blue LEDs coated with phosphor P2. In a first implementation, in the LED lamp 10 or 150-1, the phosphors P1 and P2 to can be red and green, respectively. In a second implementation, in the LED lamp 10 or 150-1, the phosphors P1 and P2 can be reddish yellow and yellow, respectively. In a third implementation, in the LED lamp 10 or 150-1, the phosphors P1 and P2 can be red and yellow, respectively.

Figure 12A:
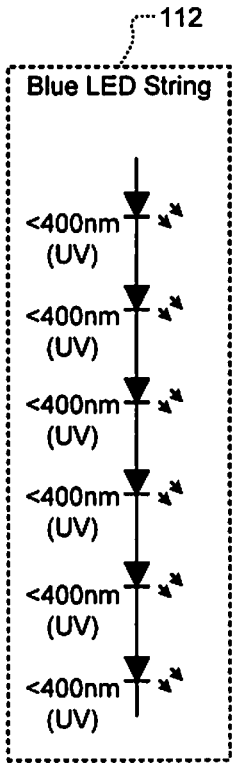
FIG. 12A depicts one of a plurality of LED strings used to produce blue light used in producing white light, where the LED string includes LEDs producing ultraviolet light that is converted to blue light by a blue phosphor.
Figure 12B:
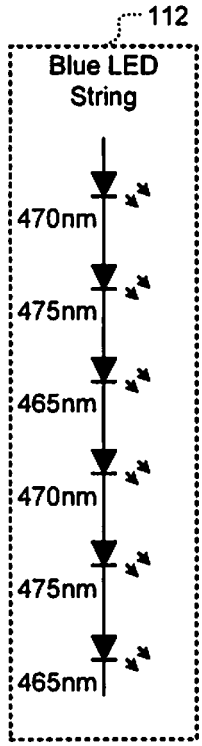
FIG. 12B depicts of a plurality of LED strings used to produce blue light used in producing white light, where the LED string includes blue LEDs generating blue light having preselected wavelengths, and where the blue LEDs are arranged in a predetermined order.

Referring now to FIGS. 12A and 12B, the blue LED string 112 shown in FIG. 4 can be implemented in different ways. For example, in one implementation shown in FIG. 12A, the LED string 112 may include ultraviolet LEDs coated with blue phosphor. In another implementation shown in FIG. 12B, the LED string 112 may include blue LEDs generating blue light having different wavelengths that may be preselected and arranged in a predetermined order. For example, blue LEDs producing blue light having wavelengths 470 nm, 475 nm, and 465 nm may be selected and arranged as shown. Other wavelengths may be selected instead. The LEDs may be arranged in a different order than shown. In this implementation, the blue wavelengths average out to provide uniform blue light.

Figure 13:
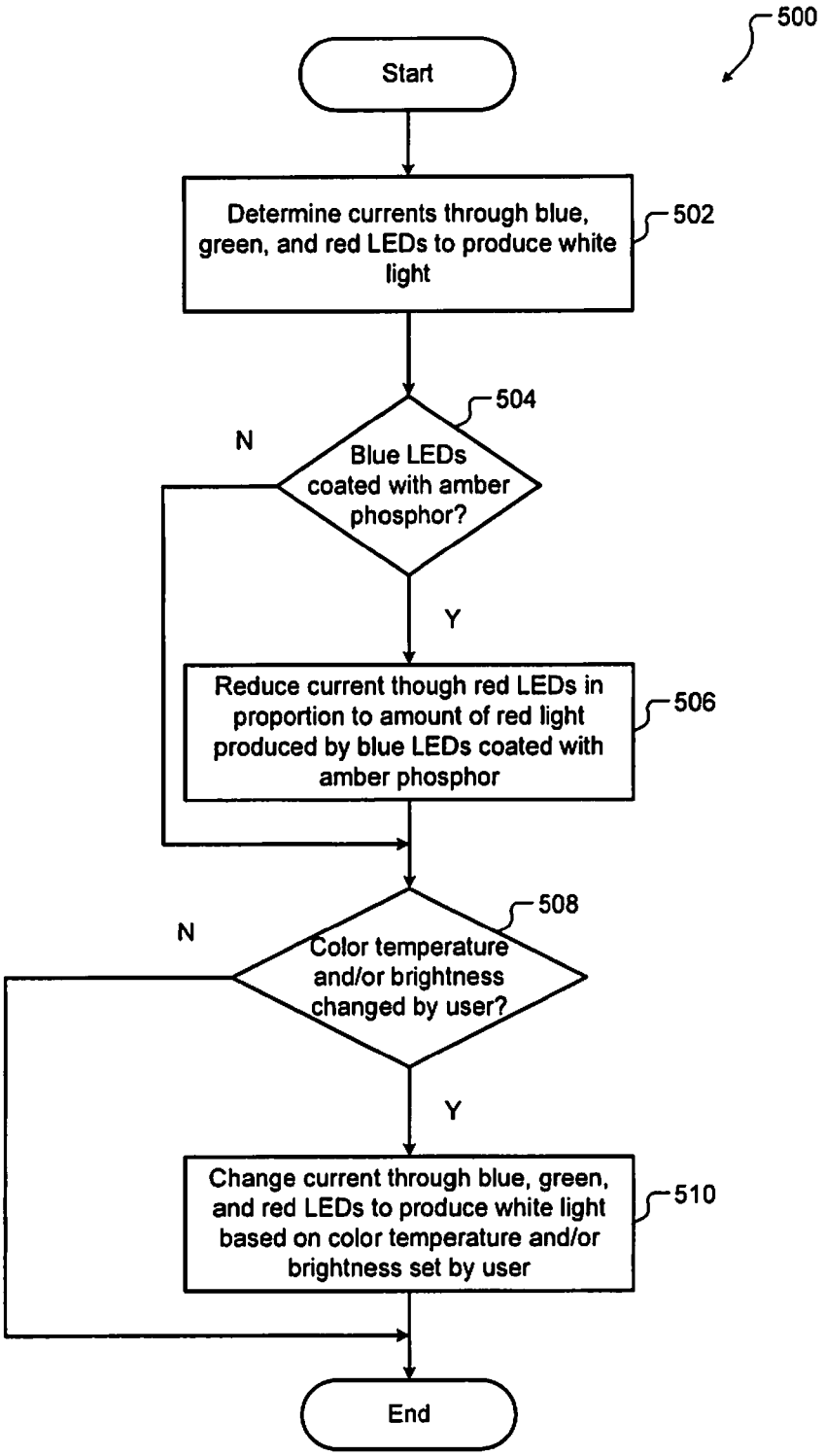
FIG. 13 is a flowchart of a method for generating white light according to the present disclosure.

Referring now to FIG. 13, a method 500 for generating white light according to the present disclosure is shown. At 502, control determines the currents through the blue, green, and red LEDs to produce white light. The green and red LEDs are blue LEDs coated with green and red phosphors, respectively. The blue LEDs may not be coated with a phosphor to convert blue light into a light of a different color or may be coated with amber phosphor. At 504, control determines if the blue LEDs are coated with amber phosphor. At 506, if the blue LEDs are coated with amber phosphor, control reduces current through the red LEDs in proportion to an amount of red light produced by the blue LEDs coated with amber phosphor. At 508, control determines if a color temperature and/or brightness of the white light is changed by a user. At 510, if the user changes the color temperature and/or brightness of the white light, control changes current through the blue, green, and red LEDs to produce white light having the color temperature and/or brightness selected by the user.

Figure 14:
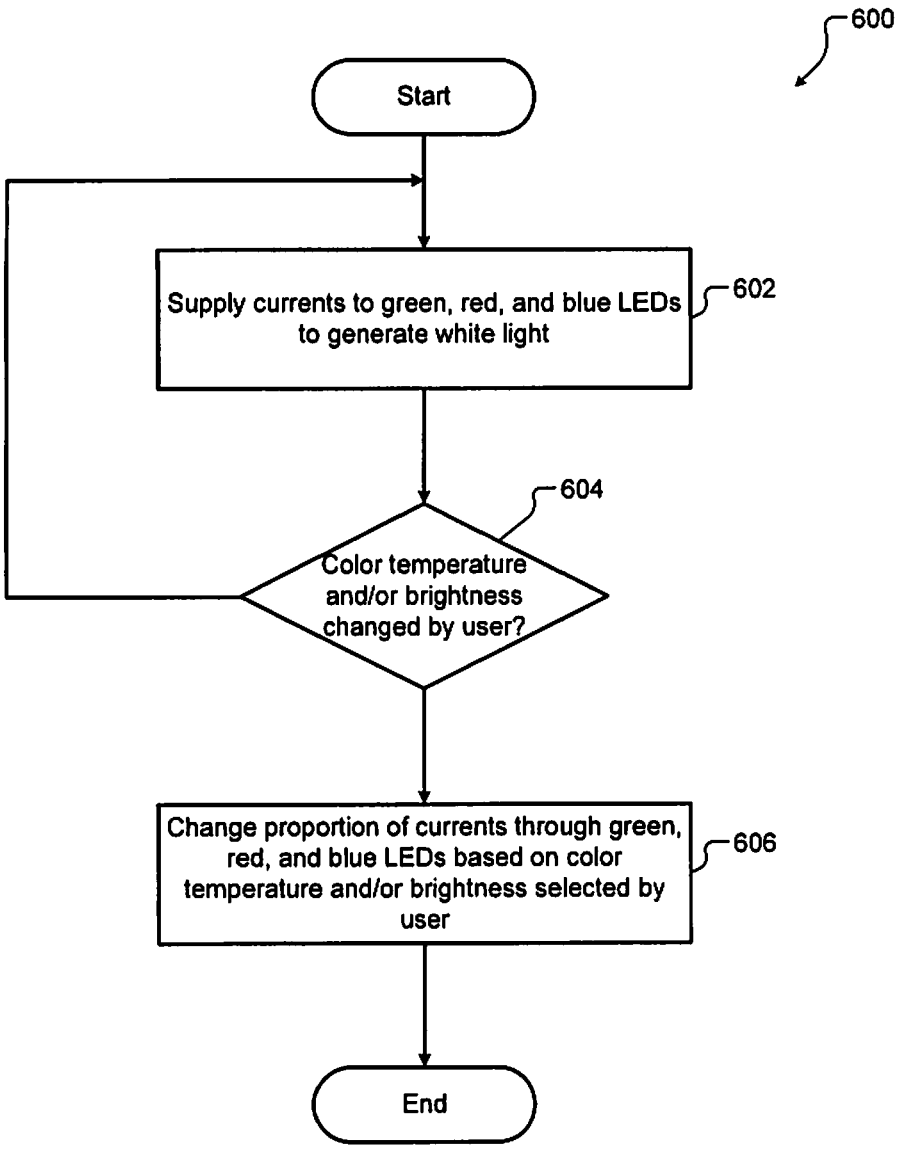
FIG. 14 is a flow chart of a method for controlling currents through a plurality of strings of LEDs used in the LED lamps disclosed herein according to the present disclosure.

Referring now to FIG. 14, a method 600 for controlling a color temperature of white light generated by an LED lamp according to the present disclosure is shown. At 602, control supplies currents to green, red, and blue LEDs to generate white light. The green and red LEDs are blue LEDs coated with green and red phosphors, respectively. The blue LEDs may not be coated with a phosphor to convert blue light to a light of a different color or may be coated with amber phosphor. At 604, control determines if a user changed the color temperature and/or brightness of the white light. At 606, if the user changed the color temperature and/or brightness of the white light, control changes the proportion of currents through the green, red, and blue LEDs based on the color temperature and/or brightness selected by the user.

The foregoing description is merely illustrative in nature and is in no way intended to limit the disclosure, its application, or uses. For example, the wavelength values and ranges are approximate and provided for illustrative purposes only and are not intended to be limiting. Based on the disclosure and teachings provided herein, a person of ordinary skill in the art would appreciate the various other wavelength values and ranges that may be used. The broad teachings of the disclosure can be implemented in a variety of forms. Therefore, while this disclosure includes particular examples, the true scope of the disclosure should not be so limited since other modifications will become apparent upon a study of the drawings, the specification, and the following claims. For purposes of clarity, the same reference numbers will be used in the drawings to identify similar elements. As used herein, the phrase at least one of A, B, and C should be construed to mean a logical (A or B or C), using a non-exclusive logical OR. It should be understood that one or more steps within a method may be executed in different order (or concurrently) without altering the principles of the present disclosure.

As used herein, the term module may refer to, be part of, or include an Application Specific Integrated Circuit (ASIC); a discrete circuit; an integrated circuit; a combinational logic circuit; a field programmable gate array (FPGA); a processor (shared, dedicated, or group) that executes code; other suitable hardware components that provide the described functionality; or a combination of some or all of the above, such as in a system-on-chip. The term module may include memory (shared, dedicated, or group) that stores code executed by the processor.

The term code, as used above, may include software, firmware, and/or microcode, and may refer to programs, routines, functions, classes, and/or objects. The term shared, as used above, means that some or all code from multiple modules may be executed using a single (shared) processor. In addition, some or all code from multiple modules may be stored by a single (shared) memory. The term group, as used above, means that some or all code from a single module may be executed using a group of processors. In addition, some or all code from a single module may be stored using a group of memories.

The apparatuses and methods described herein may be partially or fully implemented by one or more computer programs executed by one or more processors. The computer programs include processor-executable instructions that are stored on at least one non-transitory tangible computer readable medium. The computer programs may also include and/or rely on stored data. Non-limiting examples of the non-transitory tangible computer readable medium include nonvolatile memory, volatile memory, magnetic storage, and optical storage.

What is claimed is:

1. A system comprising:

a first transistor configured to supply a first current to a first load connected to a first terminal of the first transistor;

a second transistor configured to supply a second current to a second load connected to a first terminal of the second transistor, wherein the first current and the second current have a predetermined ratio; and a comparator configured to compare a voltage at the first terminal of the first transistor or a voltage at the first terminal of the second transistor to a reference voltage, and adjust, based on the comparison, biasing of the first transistor and the second transistor to maintain the predetermined ratio between the first current and the second current.

2. The system of claim 1, wherein in response to a change in the first current, the adjusted biasing changes the second current in accordance with the predetermined ratio between the first current and the second current.

3. The system of claim 1, wherein the predetermined ratio between the first current and the second current is based on a ratio of areas of the first transistor and the second transistor.

4. The system of claim 1, wherein in response to a change in power received by the first load and the second load, the comparator is configured to adjust the biasing of the first transistor and the second transistor to maintain the predetermined ratio between the first current and the second current.

5. The system of claim 1, wherein in response to a change in power received by the first load and the second load, the comparator is configured to adjust the first current and the second current to maintain the predetermined ratio between the first current and the second current.

6. The system of claim 1, wherein:

the first load includes a first set of light emitting diodes configured to generate light having first wavelengths in a first wavelength range in a spectrum of blue light, the second load includes a second set of light emitting diodes configured to generate light having second wavelengths in a second wavelength range in the spectrum of blue light, the first wavelength range is less than a third wavelength range in the spectrum of blue light, the second wavelength range is greater than the third wavelength range, the light generated by the first set of light emitting diodes and the second set of light emitting diodes combines to produce white light, and a color temperature of the white light depends on the predetermined ratio.

7. The system of claim 6, wherein the first wavelengths are less than or equal to 450 nanometers, and wherein the second wavelengths are greater than or equal to 470 nanometers.

8. The system of claim 6, wherein the first wavelengths are between 420 nanometers and 450 nanometers, and wherein the second wavelengths are between 470 nanometers and 490 nanometers.

9. The system of claim 1, wherein the first load includes a first set of light emitting diodes configured to generate blue light having first wavelengths in a first wavelength range in a spectrum of blue light, and wherein the second load includes a second set of light emitting diodes configured to generate blue light having second wavelengths in a second wavelength range in the spectrum of blue light, the system further comprising:

a green phosphor configured to convert a first portion of the blue light having the first wavelengths into green light, and allow a second portion of the blue light having the first wavelengths to escape unconverted; and a red phosphor configured to convert a third portion of the blue light having the second wavelengths into red light, and allow a fourth portion of the blue light having the second wavelengths to escape unconverted, wherein the green light, the red light, the second portion of the blue light having the first wavelengths, and fourth portion of the blue light having the second wavelengths combine to produce white light, and wherein a color temperature of the white light depends on the predetermined ratio.

10. The system of claim 9, wherein:

the first wavelength range is less than a third wavelength range in the spectrum of blue light, and the second wavelength range is greater than the third wavelength range.

11. The system of claim 9, wherein the first wavelengths are less than or equal to 450 nanometers, and wherein the second wavelengths are greater than or equal to 470 nanometers.

12. The system of claim 11, wherein the first wavelengths are between 420 nanometers and 450 nanometers, and wherein the second wavelengths are between 470 nanometers and 490 nanometers.

13. A system comprising:

a first transistor configured to supply a first current to a first set of light emitting diodes connected to a first terminal of the first transistor, wherein the first set of light emitting diodes is configured to output light having first wavelengths in a first wavelength range in a spectrum of blue light;

a second transistor configured to supply a second current to a second set of light emitting diodes connected to a first terminal of the second transistor, wherein the second set of light emitting diodes is configured to output light having second wavelengths in a second wavelength range in the spectrum of blue light;

a third transistor configured to supply a third current to a third set of light emitting diodes connected to a first terminal of the third transistor, wherein the third set of light emitting diodes is configured to output light having third wavelengths in a third wavelength range in the spectrum of blue light, and wherein the third wavelength range is (i) less than the second wavelength range and (ii) greater than the first wavelength range, wherein values of the first current, the second current, and the third current are in a predetermined proportion; and a comparator configured to compare a voltage at the first terminal of the first transistor, a voltage at the first terminal of the second transistor, or a voltage at the first terminal of the third transistor to a reference voltage, and adjust, based on the comparison, biasing of the first transistor, the second transistor, and the third transistor to maintain the predetermined proportion between the first current, the second current, and the third current, wherein a color temperature of white light generated based on the light output by the first, second, and third sets of light emitting diodes depends on the predetermined proportion of the first current, the second current, and the third current.

14. The system of claim 13, wherein in response to a change in the first current, the adjusted biasing changes the second current and the third current in accordance with the predetermined proportion between the first current, the second current, and the third current.

15. The system of claim 13, wherein the predetermined proportion between the first current, the second current, and the third current is based on a proportion of areas of the first transistor, the second transistor, and the third transistor.

16. The system of claim 13, wherein in response to a change in power received by the first, second, and third sets of light emitting diodes, the comparator is configured to adjust the biasing of the first transistor, the second transistor, and the third transistor to maintain the predetermined proportion between the first current, the second current, and the third current.

17. The system of claim 13, wherein in response to a change in power received by the first, second, and third sets of light emitting diodes, the comparator is configured to adjust the first current, the second current, and the third current to maintain the predetermined proportion between the first current, the second current, and the third current.

18. The system of claim 13, wherein:

the first, second, and third sets of the light emitting diodes are configured to output blue light;

the first set of light emitting diodes includes a green phosphor configured to convert the blue light having the first wavelengths into green light;

the second set of light emitting diodes includes a red phosphor configured to convert the blue light having the second wavelengths into red light;

the third set of light emitting diodes is configured to output blue light having the third wavelengths;

the green light, the red light, and the blue light having the third wavelengths combine to produce the white light; and amounts of the green light, the red light, and the blue light are proportional to the predetermined proportion of the first current, the second current, and the third current.

19. The system of claim 13, wherein:

the first, second, and third sets of the light emitting diodes are configured to output blue light;

the first set of light emitting diodes includes a green phosphor configured to convert the blue light having the first wavelengths into green light;

the second set of light emitting diodes includes a red phosphor configured to convert the blue light having the second wavelengths into red light;

the third set of light emitting diodes includes an amber phosphor configured to (i) convert a portion of the blue light having the third wavelengths to red light and (ii) allow a remainder of the blue light having the third wavelengths to pass through the amber phosphor unconverted; and the green light, the red light converted using the red phosphor and the red light converted using the amber phosphor, and the blue light having the third wavelengths combine to produce the white light.

20. A system comprising:

a first transistor configured to supply a first current to a first set of light emitting diodes connected to a first terminal of the first transistor, wherein the first set of light emitting diodes is configured to output light having first wavelengths in a first wavelength range in a spectrum of blue light;

a second transistor configured to supply a second current to a second set of light emitting diodes connected to a first terminal of the second transistor, wherein the second set of light emitting diodes is configured to output light having the first wavelengths in the first wavelength range in the spectrum of blue light;

a third transistor configured to supply a third current to a third set of light emitting diodes connected to a first terminal of the third transistor, wherein the third set of light emitting diodes is configured to output light having second wavelengths in a second wavelength range in a spectrum of ultraviolet light, wherein values of the first current, the second current, and the third current are in a predetermined proportion; and a comparator configured to compare a voltage at the first terminal of the first transistor, a voltage at the first terminal of the second transistor, or a voltage at the first terminal of the third transistor to a reference voltage, and adjust, based on the comparison, biasing of the first transistor, the second transistor, and the third transistor to maintain the predetermined proportion between the first current, the second current, and the third current, wherein a color temperature of white light generated based on the light output by the first, second, and third sets of light emitting diodes depends on the predetermined proportion of the first current, the second current, and the third current.

21. The system of claim 20, wherein in response to a change in the first current, the adjusted biasing changes the second current and the third current in accordance with the predetermined proportion between the first current, the second current, and the third current.

22. The system of claim 20, wherein the predetermined proportion between the first current, the second current, and the third current is based on a proportion of areas of the first transistor, the second transistor, and the third transistor.

23. The system of claim 20, wherein in response to a change in power received by the first, second, and third sets of light emitting diodes, the comparator is configured to adjust the biasing of the first transistor, the second transistor, and the third transistor to maintain the predetermined proportion between the first current, the second current, and the third current.

24. The system of claim 20, wherein in response to a change in power received by the first, second, and third sets of light emitting diodes, the comparator is configured to adjust the first current, the second current, and the third current to maintain the predetermined proportion between the first current, the second current, and the third current.

25. The system of claim 20, wherein:

the first and second sets of the light emitting diodes are configured to output blue light;

the third set of light emitting diodes is configured to output ultraviolet light;

the first set of light emitting diodes includes a green phosphor configured to convert the blue light having the first wavelengths into green light;

the second set of light emitting diodes includes a red phosphor configured to convert the blue light having the first wavelengths into red light;

the third set of light emitting diodes includes a blue phosphor configured to convert the ultraviolet light having the second wavelengths to blue light having third wavelengths in the spectrum of blue light;

the green light, the red light, and the blue light having the third wavelengths combine to produce the white light; and amounts of the green light, the red light, and the blue light are proportional to the predetermined proportion of the first current, the second current, and the third current.

26. The system of claim 20, wherein:

the first and second sets of the light emitting diodes are configured to output blue light;

the third set of light emitting diodes is configured to output ultraviolet light;

the first set of light emitting diodes includes a reddish yellow phosphor configured to convert the blue light having the first wavelengths into reddish yellow light;

the second set of light emitting diodes includes a yellow phosphor configured to convert the blue light having the first wavelengths into yellow light;

the third set of light emitting diodes includes a blue phosphor configured to convert the ultraviolet light having the second wavelengths to blue light having third wavelengths in the spectrum of blue light;

the reddish yellow light, the yellow light, and the blue light having the third wavelengths combine to produce the white light; and amounts of the reddish yellow light, the yellow light, and the blue light are proportional to the predetermined proportion of the first current, the second current, and the third current.

27. The system of claim 20, wherein:

the first and second sets of the light emitting diodes are configured to output blue light;

the third set of light emitting diodes is configured to output ultraviolet light;

the first set of light emitting diodes includes a red phosphor configured to convert the blue light having the first wavelengths into red light;

the second set of light emitting diodes includes a yellow phosphor configured to convert the blue light having the first wavelengths into yellow light;

the third set of light emitting diodes includes a blue phosphor configured to convert the ultraviolet light having the second wavelengths to blue light having third wavelengths in the spectrum of blue light; and the red light, the yellow light, and the blue light having the third wavelengths combine to produce the white light.

28. A method comprising:

supplying a first current to a first load connected to a first terminal of a first transistor;

supplying a second current to a second load connected to a first terminal of a second transistor, wherein the first current and the second current have a predetermined ratio;

comparing a voltage at the first terminal of the first transistor or a voltage at the first terminal of the second transistor to a reference voltage; and adjusting, based on the comparison, biasing of the first transistor and the second transistor to maintain the predetermined ratio between the first current and the second current.

29. The method of claim 28, further comprising in response to a change in the first current, based on the adjusted biasing, changing the second current in accordance with the predetermined ratio between the first current and the second current.

30. The method of claim 28, wherein the predetermined ratio between the first current and the second current is based on a ratio of areas of the first transistor and the second transistor.

31. The method of claim 28, further comprising in response to a change in power received by the first load and the second load, adjusting the biasing of the first transistor and the second transistor to maintain the predetermined ratio between the first current and the second current.

32. The method of claim 28, further comprising in response to a change in power received by the first load and the second load, adjusting the first current and the second current to maintain the predetermined ratio between the first current and the second current.

33. The method of claim 28, further comprising:

generating, using a first set of light emitting diodes included in the first load, light having first wavelengths in a first wavelength range in a spectrum of blue light; and generating, using a second set of light emitting diodes included in the second load, light having second wavelengths in a second wavelength range in the spectrum of blue light, wherein the first wavelength range is less than a third wavelength range in the spectrum of blue light, and wherein the second wavelength range is greater than the third wavelength range; and producing white light by combining the light generated by the first set of light emitting diodes and the second set of light emitting diodes, wherein a color temperature of the white light depends on the predetermined ratio.

34. The method of claim 33, wherein the first wavelengths are less than or equal to 450 nanometers, and wherein the second wavelengths are greater than or equal to 470 nanometers.

35. The method of claim 33, wherein the first wavelengths are between 420 nanometers and 450 nanometers, and wherein the second wavelengths are between 470 nanometers and 490 nanometers.

36. The method of claim 28, further comprising:

generating, using a first set of light emitting diodes included in the first load, blue light having first wavelengths in a first wavelength range in a spectrum of blue light;

generating, using a second set of light emitting diodes included in the second load, blue light having second wavelengths in a second wavelength range in the spectrum of blue light;

converting, using a green phosphor, a first portion of the blue light having the first wavelengths into green light;

allowing a second portion of the blue light having the first wavelengths to escape unconverted;

converting, using a red phosphor, a third portion of the blue light having the second wavelengths into red light;

allowing a fourth portion of the blue light having the second wavelengths to escape unconverted; and producing white light by combining the green light, the red light, the second portion of the blue light having the first wavelengths, and fourth portion of the blue light having the second wavelengths, wherein a color temperature of the white light depends on the predetermined ratio.

37. The method of claim 36, wherein:

the first wavelength range is less than a third wavelength range in the spectrum of blue light, and the second wavelength range is greater than the third wavelength range.

38. The method of claim 36, wherein the first wavelengths are less than or equal to 450 nanometers, and wherein the second wavelengths are greater than or equal to 470 nanometers.

39. The method of claim 38, wherein the first wavelengths are between 420 nanometers and 450 nanometers, and wherein the second wavelengths are between 470 nanometers and 490 nanometers.

40. A method comprising:

supplying a first current to a first set of light emitting diodes connected to a first terminal of a first transistor;

outputting, from the first set of light emitting diodes, light having first wavelengths in a first wavelength range in a spectrum of blue light;

supplying a second current to a second set of light emitting diodes connected to a first terminal of a second transistor;

outputting, from the second set of light emitting diodes, light having the first wavelengths in the first wavelength range in the spectrum of blue light;

supplying a third current to a third set of light emitting diodes connected to a first terminal of a third transistor;

outputting, from the third set of light emitting diodes, light having second wavelengths in a second wavelength range in a spectrum of ultraviolet light, wherein values of the first current, the second current, and the third current are in a predetermined proportion;

comparing a voltage at the first terminal of the first transistor, a voltage at the first terminal of the second transistor, or a voltage at the first terminal of the third transistor to a reference voltage; and adjusting, based on the comparison, biasing of the first transistor, the second transistor, and the third transistor to maintain the predetermined proportion between the first current, the second current, and the third current, wherein a color temperature of white light generated based on the light output by the first, second, and third sets of light emitting diodes depends on the predetermined proportion of the first current, the second current, and the third current.

41. The method of claim 40, further comprising in response to a change in the first current, based on the adjusted biasing, changing the second current and the third current in accordance with the predetermined proportion between the first current, the second current, and the third current.

42. The method of claim 40, wherein the predetermined proportion between the first current, the second current, and the third current is based on a proportion of areas of the first transistor, the second transistor, and the third transistor.

43. The method of claim 40, further comprising in response to a change in power received by the first, second, and third sets of light emitting diodes, adjusting the biasing of the first transistor, the second transistor, and the third transistor to maintain the predetermined proportion between the first current, the second current, and the third current.

44. The method of claim 40, further comprising in response to a change in power received by the first, second, and third sets of light emitting diodes, adjusting the first current, the second current, and the third current to maintain the predetermined proportion between the first current, the second current, and the third current.

45. The method of claim 40, further comprising:

outputting blue light from the first and second sets of the light emitting diodes;

outputting ultraviolet light from the third set of light emitting diodes;

converting, using a green phosphor, the blue light having the first wavelengths into green light;

converting, using a red phosphor, the blue light having the first wavelengths into red light;

converting, using a blue phosphor, the ultraviolet light having the second wavelengths to blue light having third wavelengths in the spectrum of blue light; and producing the white light by combining the green light, the red light, and the blue light having the third wavelengths, wherein amounts of the green light, the red light, and the blue light are proportional to the predetermined proportion of the first current, the second current, and the third current.

46. The method of claim 40, further comprising:

outputting blue light using the first and second sets of the light emitting diodes;

outputting ultraviolet light using the third set of light emitting diodes;

converting, using a reddish yellow phosphor, the blue light having the first wavelengths into reddish yellow light;

converting, using a yellow phosphor, the blue light having the first wavelengths into yellow light;

converting, using a blue phosphor, the ultraviolet light having the second wavelengths to blue light having third wavelengths in the spectrum of blue light; and producing the white light by combining the reddish yellow light, the yellow light, and the blue light having the third wavelengths, wherein amounts of the reddish yellow light, the yellow light, and the blue light are proportional to the predetermined proportion of the first current, the second current, and the third current.

47. The method of claim 40, further comprising:

outputting blue light using the first and second sets of the light emitting diodes;

outputting ultraviolet light using the third set of light emitting diodes;

converting, using a red phosphor, the blue light having the first wavelengths into red light;

converting, using a yellow phosphor, the blue light having the first wavelengths into yellow light;

converting, using a blue phosphor, the ultraviolet light having the second wavelengths to blue light having third wavelengths in the spectrum of blue light; and producing the white light by combining the red light, the yellow light, and the blue light having the third wavelengths.

* * * * *